US012059071B2

(12) United States Patent
Kobayashi

(10) Patent No.: US 12,059,071 B2
(45) Date of Patent: Aug. 13, 2024

(54) STORAGE CASE

(71) Applicant: Iris Ohyama Inc., Sendai (JP)

(72) Inventor: Susumu Kobayashi, Miyagi (JP)

(73) Assignee: Iris Ohyama Inc., Sendai (JP)

( * ) Notice: Subject to any disclaimer, the term of this patent is extended or adjusted under 35 U.S.C. 154(b) by 241 days.

(21) Appl. No.: 17/637,609

(22) PCT Filed: Aug. 28, 2020

(86) PCT No.: PCT/JP2020/032722
§ 371 (c)(1),
(2) Date: Feb. 23, 2022

(87) PCT Pub. No.: WO2021/040009
PCT Pub. Date: Mar. 4, 2021

(65) Prior Publication Data

US 2022/0279925 A1 Sep. 8, 2022

(30) Foreign Application Priority Data

Aug. 28, 2019 (JP) ..... 2019-155562

(51) Int. Cl.
*A47B 67/04* (2006.01)

(52) U.S. Cl.
CPC ..... *A47B 67/04* (2013.01)

(58) Field of Classification Search
CPC ..... A47B 67/04; A47B 47/00; A47B 47/0091
USPC ..... 312/107, 108
See application file for complete search history.

(56) References Cited

U.S. PATENT DOCUMENTS 5,466,058 A * 11/1995 Chan ..... A47B 95/02 312/109
5,839,806 A * 11/1998 Liu ..... A47B 67/04 312/265.5
5,921,646 A * 7/1999 Hwang ..... F16B 12/24 312/265.5
6,474,759 B2 * 11/2002 Hsu ..... F16B 12/26 312/263

(Continued)

FOREIGN PATENT DOCUMENTS

JP S54-104235 U 7/1979
JP 3197998 U 6/2015
JP 2017-108939 A 6/2017

OTHER PUBLICATIONS

International Search Report issued in PCT/JP2020/032722; mailed Oct. 20, 2020.

*Primary Examiner* — James O Hansen
(74) *Attorney, Agent, or Firm* — Studebaker & Brackett PC

(57) ABSTRACT

In the present invention of a storage case, a space can be saved in the packing form.
The skeleton frame of the storage case includes a pair of left and right side frames, a connecting pipe connecting the front end portions of the side frames, and a back panel connecting the rear end portions of the side frames. Therefore, in the skeleton frame, the bottom wall of the case can be supported by the support portion of the side frame without providing the bottom plate that supports the entire bottom wall of the case. As a result, when the storage case is disassembled, it is not necessary to vertically stack the bottom plates that receive the entire bottom wall of the case from below, so that it is possible to save space in the packing form of the storage case.

6 Claims, 16 Drawing Sheets

(56) References Cited

U.S. PATENT DOCUMENTS

2007/0080614 A1* 4/2007 Stein ..... A47B 47/042
312/107

* cited by examiner

STORAGE CASE

BACKGROUND OF THE INVENTION

Field of the Invention

The present invention relates to a storage case.

Background Art

The storage case described in Patent Document 1 below includes a frame-shaped main body portion and a drawer case. Further, the frame-shaped main body portion has a plurality of rectangular frame-shaped frame-forming bodies and pillars connecting the corners of the four corners of the frame-forming body, and a plurality of frame-forming bodies are arranged so as to be vertically separated from each other. The space between the upper and lower frame-forming bodies is configured as a drawer case storage unit, and the drawer case is stored in the drawer case storage unit. As a result, for example, the packing form of the storage case when the frame-shaped main body is disassembled can be such that the frame-forming bodies are stacked vertically and the drawer cases stacked vertically are placed on the stacked frame-forming bodies.

CITATION LIST

Patent Document

[Patent Document 1] JP-A-2017-108939.

SUMMARY OF THE INVENTION

Problems to be Solved by the Invention

However, in the above storage case, the frame-forming body constitutes the bottom portion of the drawer case storage portion and receives the entire bottom wall of the drawer case. Therefore, the area of the frame-forming body in a plan view is set wider than that of the drawer case. As a result, in the packing form of the storage case, it is necessary to vertically stack the frame-forming bodies having a relatively large area. As a result, as the number of tiers of the storage case increases, the packing form of the frame-forming bodies stacked vertically tends to increase in size. Therefore, in the above storage case, there is room for improvement in terms of saving space in the packing form.

It is an object of the present invention to provide a storage case capable of saving space in a packing form in consideration of the above facts.

Means to Solve Problems

One or more embodiments of the present invention is a storage case comprising: a skeleton frame that has a accommodating portion inside and can be assembled in a state where it is stacked vertically in multiple tiers; a case that is formed in the shape of a rectangular parallelepiped box that opens upward and is housed in the accommodating portion; and a top plate detachably assembled to the skeleton frame in an uppermost tier; wherein the skeleton frame is configured to include: a pair of left and right side frames with a pair of front and rear vertical pillar portions extending in the vertical direction, and a lower frame portions that connect the lower end portions of the pair of vertical pillar portions and project inward in the left-right direction of the skeleton frame than the vertical pillar portions to support both ends in the left-right direction at the bottom of the case, a front connecting member that is formed in a shape of a long rod extending in the left-right direction and is detachably assembled to the front end portion of the lower frame portion to connect the pair of side frames, and a rear connecting member that extends in the left-right direction and is detachably assembled to the rear end portion of the side frame to connect the pair of side frames.

One or more embodiments of the present invention is the storage case, wherein the lower frame portion is formed with a concave mounting portion that is open inward in the left-right direction of the skeleton frame, wherein the front connecting member has: a metal pipe that extends in the left-right direction and is formed in a cylindrical shape; and a cap fitted in the mounting portion while covering both ends in the longitudinal direction of the pipe.

One or more embodiments of the present invention is the storage case, wherein the side frame is configured to include: a fixing piece configuring the rear surface of the side frame; and a panel mounting portion that is arranged adjacent to the front side of the fixing piece and has a slit formed in the connection portion with the fixing piece that is open inward in the left-right direction of the skeleton frame, wherein, the rear connecting member is configured by a rectangular plate-shaped back panel having a plate thickness direction in the front-rear direction, and both left and right ends of the back panel are inserted into the slit and fixed to the fixing piece by a fastening member.

One or more embodiments of the present invention is the storage case, characterized in that the rear connecting member is configured by a rod-shaped member extending in the left-right direction, and is detachably assembled to the rear end portion of the lower frame portion to connect the pair of the side frames.

One or more embodiments of the present invention is the storage case, wherein the side frame is configured to include: a fixing piece configuring the rear surface of the side frame; and a panel mounting portion that is arranged adjacent to the front side of the fixing piece and has a slit formed in the connection portion with the fixing piece that is open inward in the left-right direction of the skeleton frame, characterized in that: the rear connecting member is configured by a rectangular plate-shaped back panel having a plate thickness direction in the front-rear direction and a rod-shaped member extending in the left-right direction; both ends of the back panel in the left-right direction are inserted into the slit and fixed to the fixing piece by a fastening member; and the rod-shaped member is detachably assembled to the rear end portion of the lower frame portion to connect the pair of side frames.

One or more embodiments of the present invention is the storage case wherein the side frame is configured to include: a pair of front and rear lower connecting portions protruding downward from the front end portion and the rear end portion of the lower frame portion; a pair of front and rear upper connecting recesses formed at the upper end portion of the vertical pillar portion and configured so that the lower connecting portion can be fitted; an upper frame portion that extends in the front-rear direction and connects the upper end portions of the vertical pillar portions; a pair of front and rear upper connecting portions formed on the upper frame portion and projecting upward from the upper frame portion; and a pair of front and rear lower connecting recesses formed in the lower frame portion and configured so that the upper connecting portion can be fitted.

One or more embodiments of the present invention is the storage case characterized in that: a guide rib and sliding rib extending in the front-rear direction are formed on the lower surface of the case, the guide rib is arranged between the pair of left and right side frames and above the front connecting member, and abut on the lower frame portion to limit the movement of the case in the left-right direction; and the sliding rib is in contact with the upper surface of the lower frame portion.

One or more embodiments of the present invention is the storage case wherein the case is configured to include: a case body formed in the shape of a rectangular parallelepiped box open to the upper side; and a front panel that can be detachably assembled to the front portion of the case body, characterized in that a recess opened downward is formed at the lower end portion of the front panel, and an inclined portion is formed at the upper end portion of the front panel.

The Effect of the Invention

According to one or more embodiments of the present invention, it is possible to save space in the packing form.

EMBODIMENT FOR CARRYING OUT THE INVENTION

Figure 1:
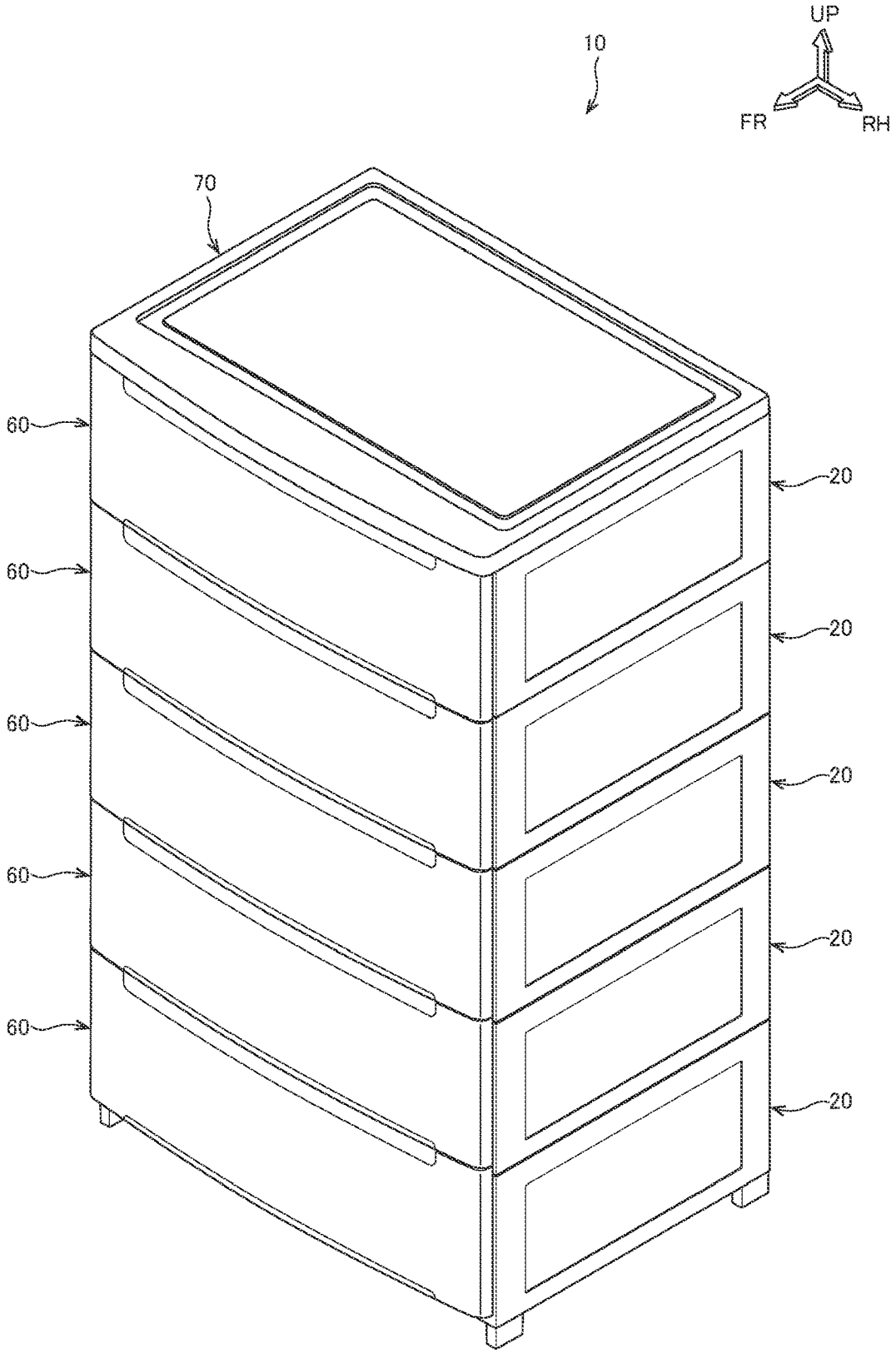
FIG. 1 is a perspective view which shows the storage case according to this embodiment.

Hereinafter, a storage case 10 according to the present embodiment will be described with reference to the drawings. Incidentally, arrow UP, arrow FR, and arrow RH appropriately illustrated in the drawings indicate an upper side, a front side, and a right side (one side of a width direction) of the storage case 10, respectively. In the following description, unless otherwise specified, vertical, front-rear, and left-right directions to be illustrated and described indicate a vertical direction, a forward and rearward direction, and a leftward and rightward direction of the storage case 10.

(Entire Configuration of Storage Case)

Figure 2:
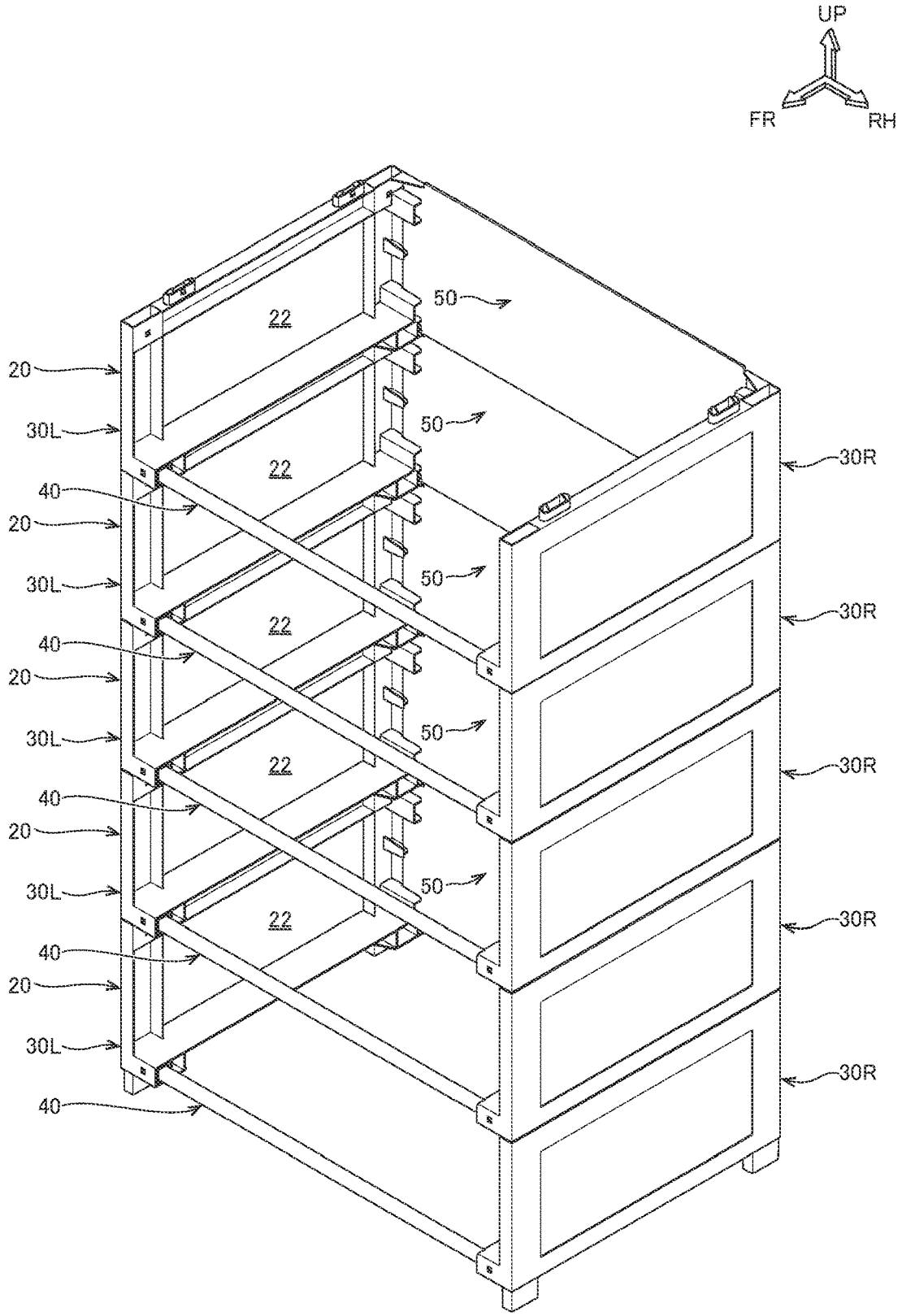
FIG. 2 is a perspective view which shows the storage case shown in FIG. 1 in the state which the case and the top plate are removed.

As shown in FIGS. 1 and 2, the storage case 10 is formed in a roughly rectangular parallelepiped shape as a whole, and is also formed in a roughly rectangular shape with the left-right direction as the longitudinal direction in a plan view from above. The storage case 10 consists of a plurality of (5 in this embodiment) skeleton frames 20 constituting the skeleton of the storage case 10, a plurality of (5 in this embodiment) cases 60, and a top plate 70 constituting the upper end portion of the storage case 10.

In the storage case 10, a plurality of skeleton frames 20 are assembled in a state of being stacked vertically, and the case 60 is housed inside each skeleton frame 20 so as to be slidable in the front-rear direction. Then, the top plate 70 is assembled to the skeleton frame 20 in the uppermost tier and covers the skeleton frame 20 and the case 60 arranged at the uppermost tier from above.

In the present embodiment, the storage case 10 has a configuration in which the skeleton frames 20 are stacked in five tiers, but the skeleton frames 20 may be stacked in two or more tiers, or the skeleton frames 20 may be configured in one tier, depending on the usage mode. Hereinafter, each configuration of the storage case 10 will be described.

(Skeleton Frame 20)

Figure 3:
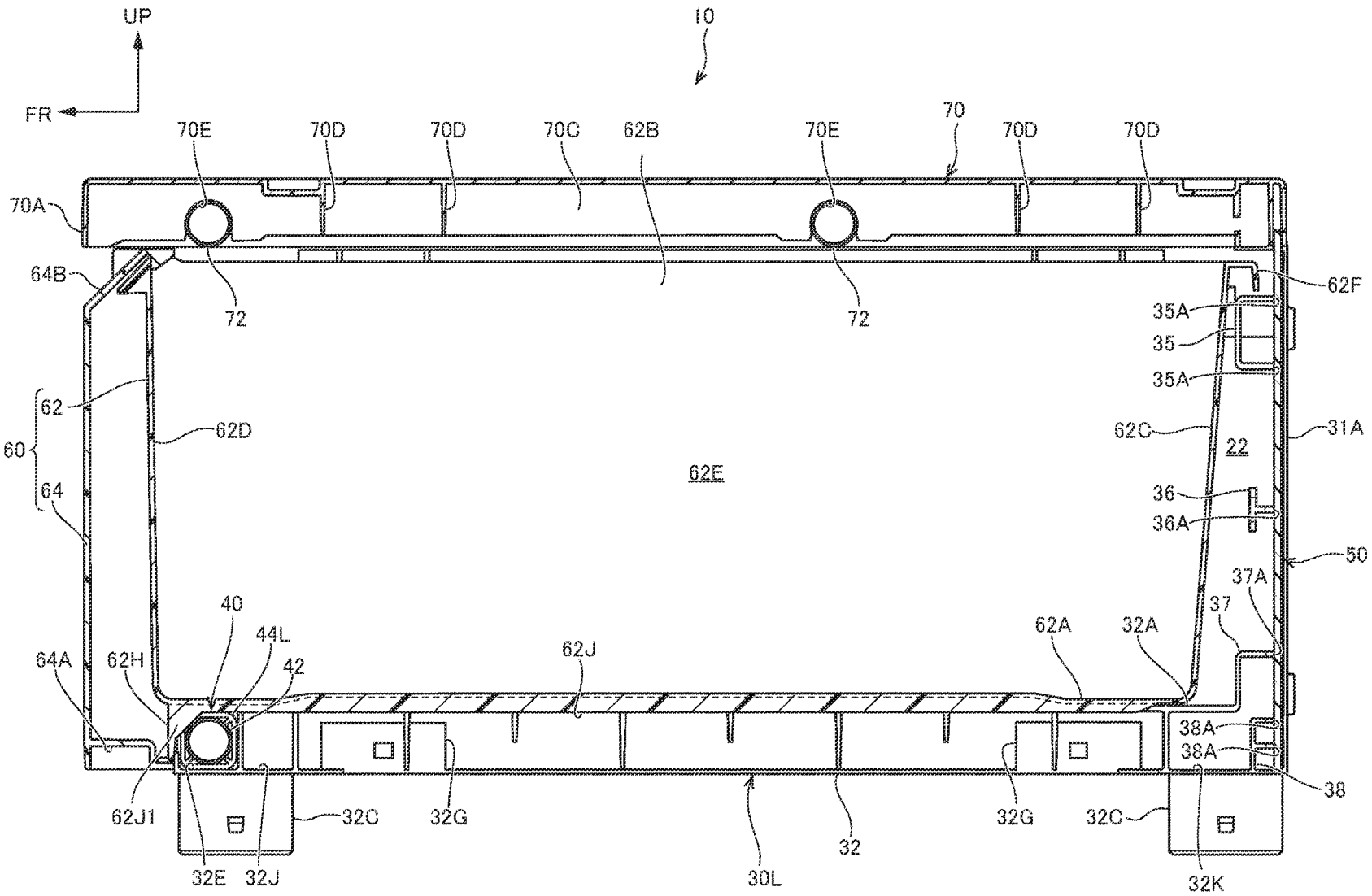
FIG. 3 is a side sectional view seen from the right side which shows the uppermost tier of the storage case shown in FIG. 1.
Figure 4:
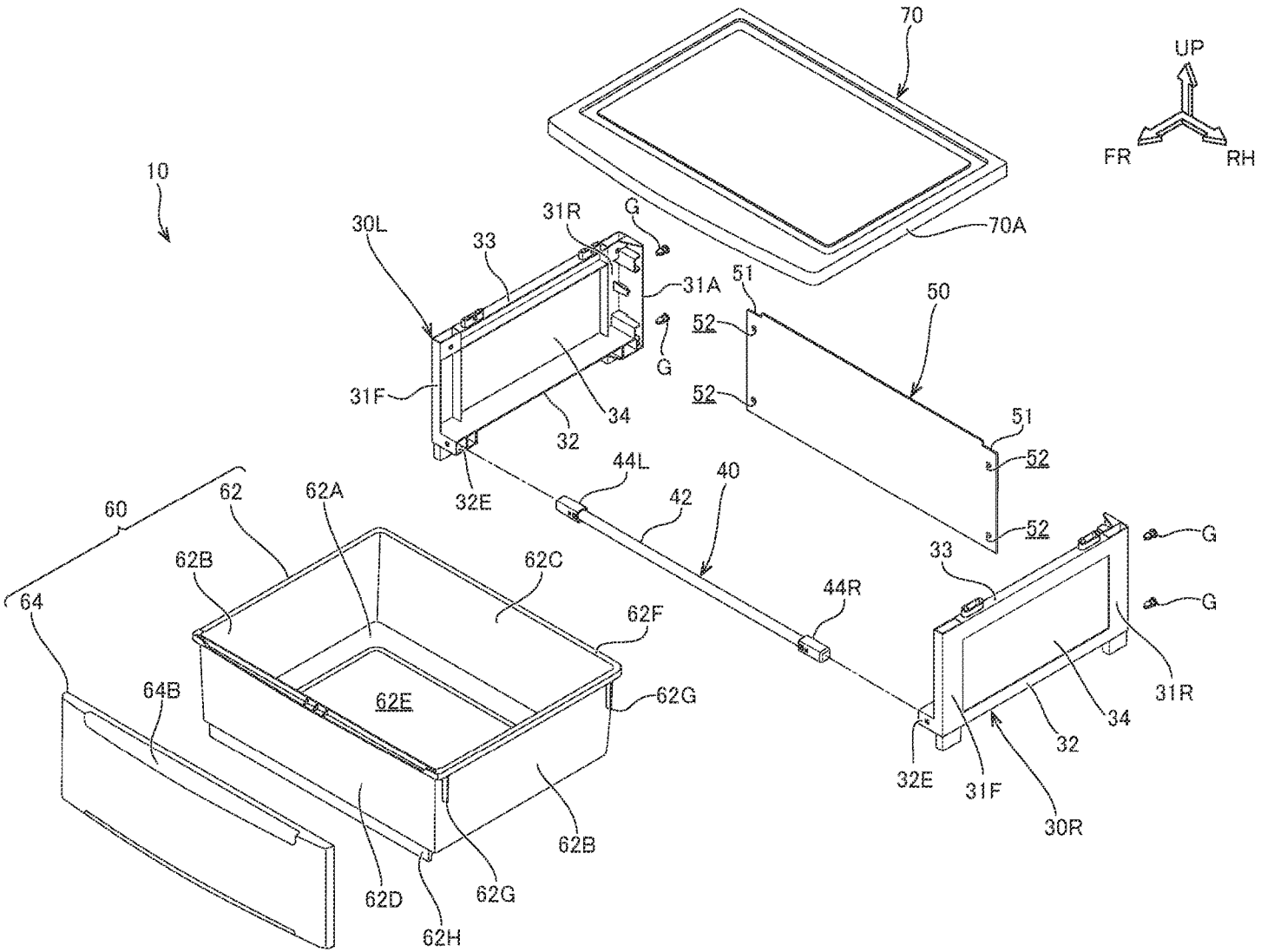
FIG. 4 is an exploded perspective view which disassembled the uppermost tier of the storage case shown in FIG. 1.

As illustrated in FIGS. 2 to 4, The skeleton frame 20 includes a pair of left and right side frames 30L, 30R that form both ends of the skeleton frame 20 in the left-right direction, a connecting pipe 40 as a "front connecting member" for connecting a pair of side frames 30L and 30R, and a back panel 50 as a "rear connecting member". The space between the pair of side frames 30L and 30R in the skeleton frame 20 is configured as the case accommodating portion 22 as the "accommodation portion", and the case 60 is housed in the case accommodating portion 22 (cf. FIG. 3).

<Side Frames 30L, 30R>

The side frames 30L and 30R are configured symmetrically with respect to the central portion in the left-right direction of the skeleton frame 20. Therefore, in the following description, the side frame 30L will be described, and the description of the side frame 30R will be omitted.

Figure 5:
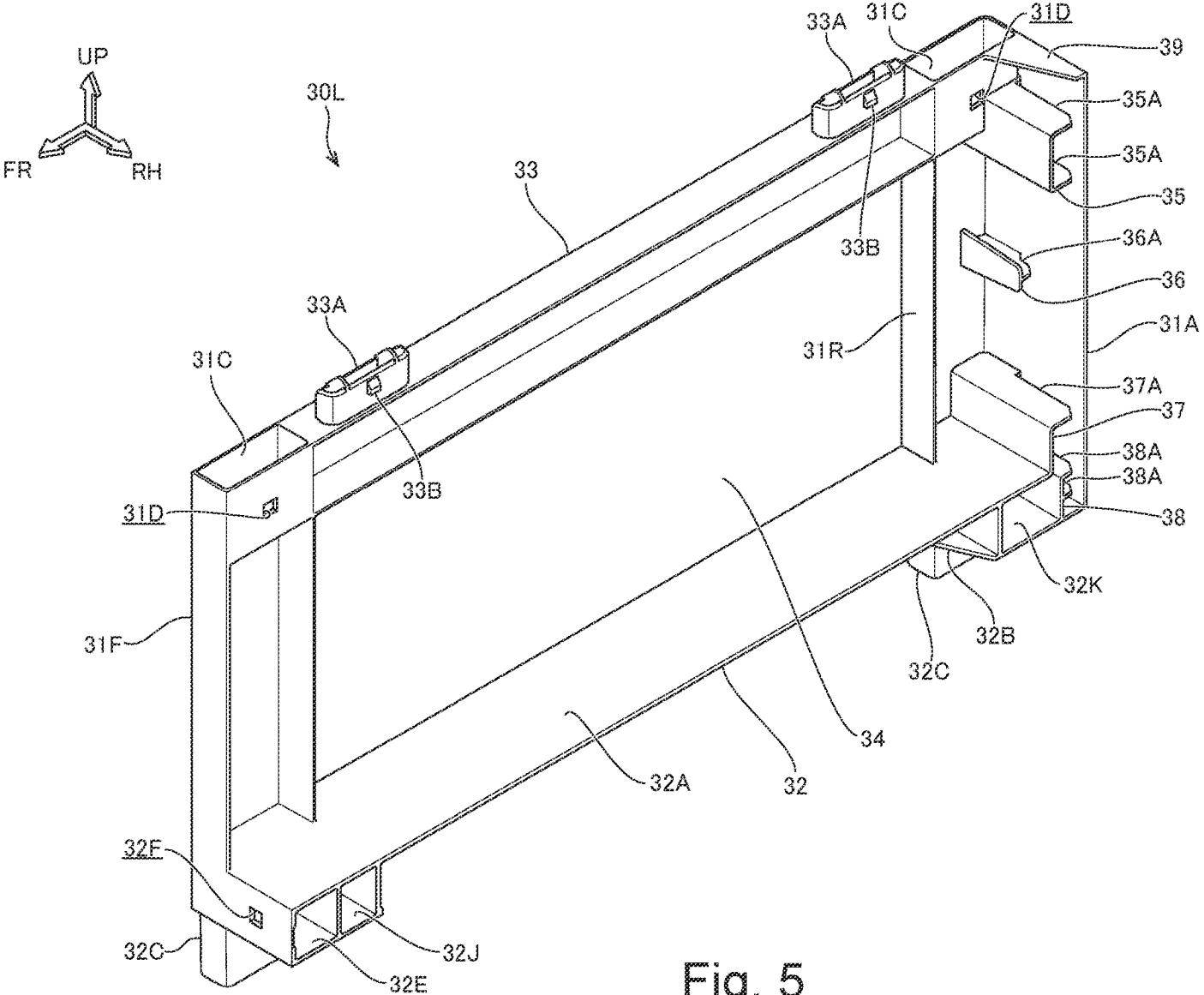
FIG. 5 is an enlarged perspective view showing the left side frame shown in FIG. 4.
Figures 6A, 6B:
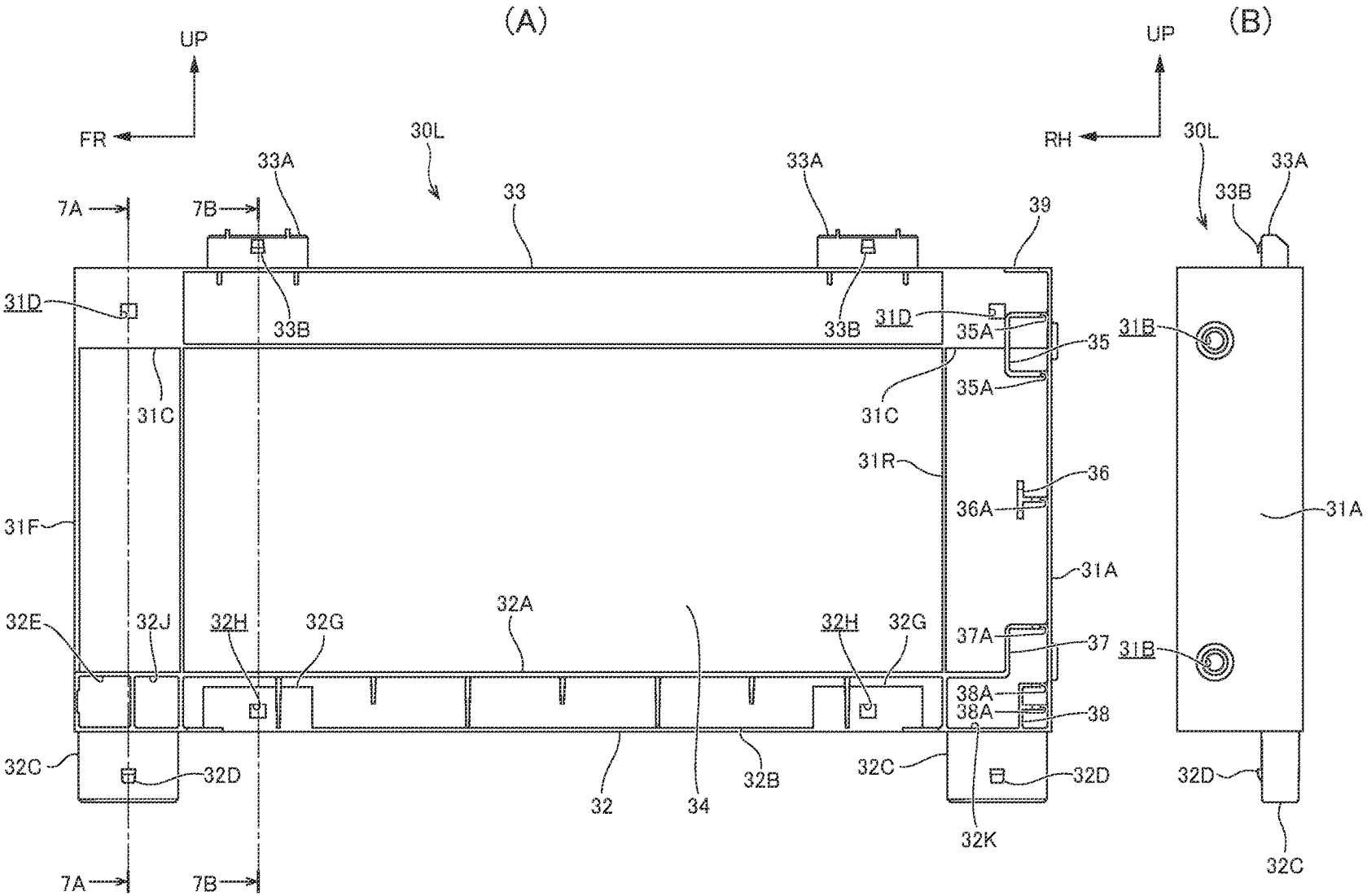
FIG. 6A is a side view seen from the right side of the side frame shown in FIGS. 5, and 6B is a rear view seen from the rear side of the side frame of 6A.
Figure 7A:
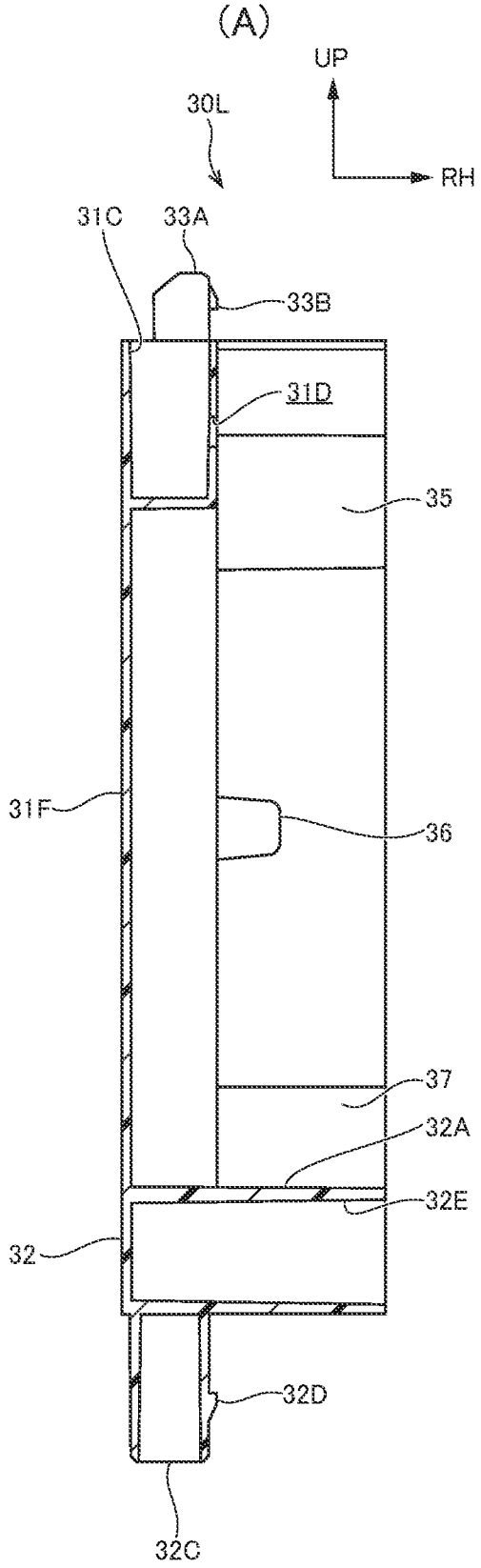
FIG. 7A is a cross-sectional view (7A-7A line cross-sectional view of FIG. 6A) as seen from the front side of the front end portion of the side frame of FIGS. 6A, and 7B is a cross-sectional view (7B-7B line cross-sectional view of FIG. 6A) as seen from the front side of the front side portion of the side frame of FIG. 6A.
Figure 7B:
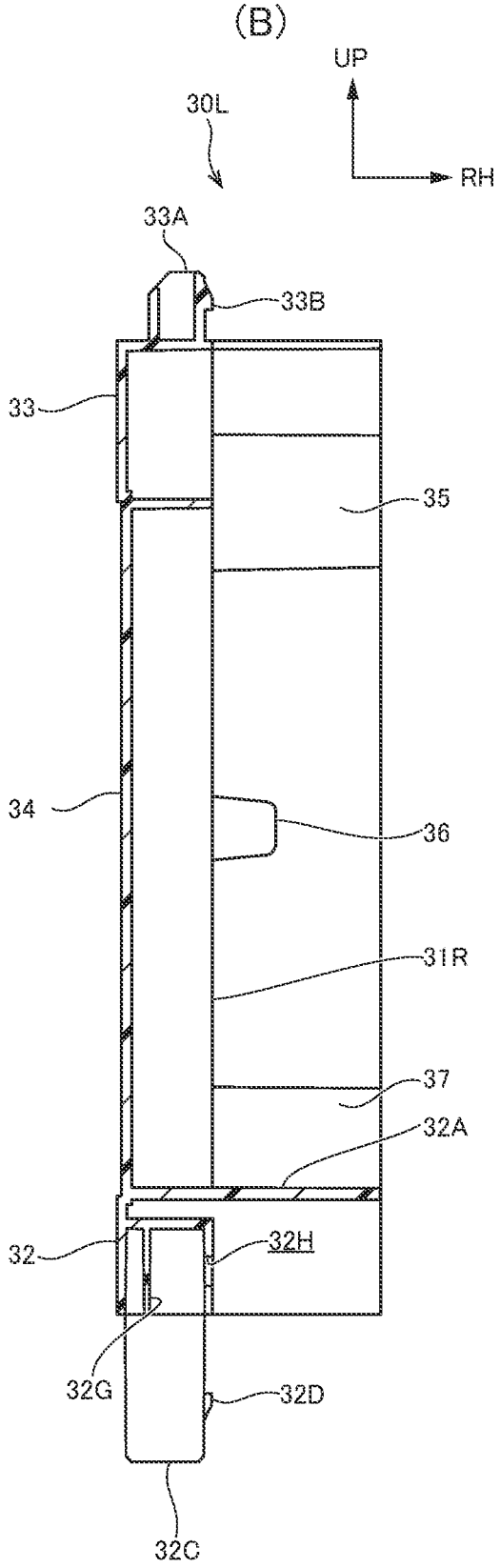
Figure 8B:
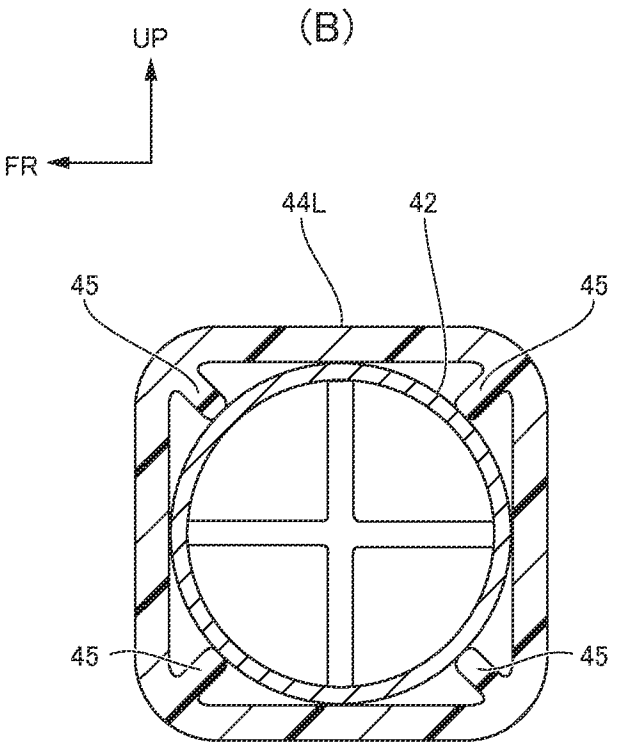
FIG. 8A is an enlarged perspective view showing the connecting pipe shown in FIGS. 4, and 8B is an enlarged cross-sectional view (8B-8B line cross-sectional view of FIG. 8A) of the left end portion of the connecting pipe of 8A.
Figure 8A:
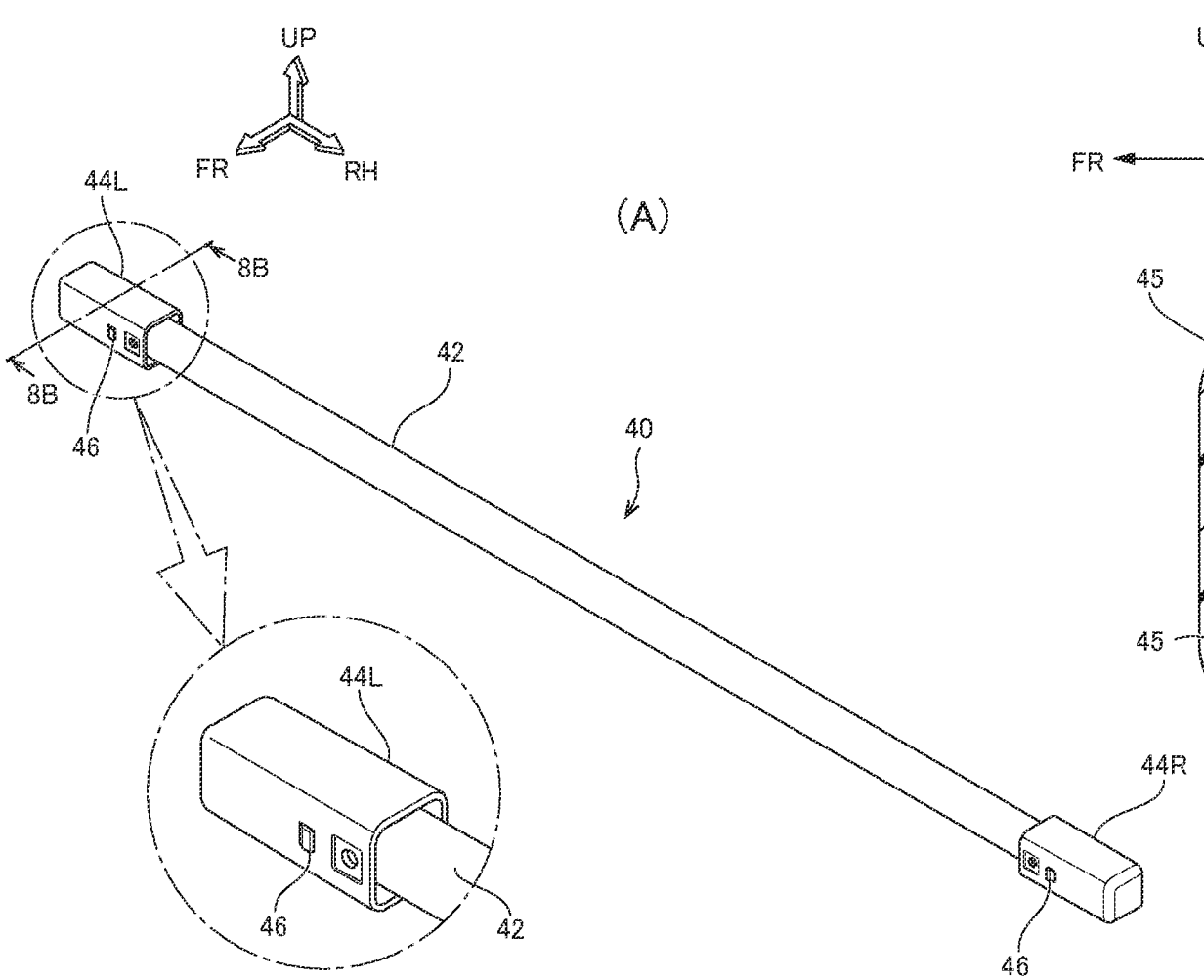

As shown in FIGS. 5 to 7, the side frame 30L is made of a resin material. The side frame 30L is formed in a roughly rectangular panel shape with the left-right direction as the plate thickness direction, and is also formed in a roughly L-shape when viewed from the front side. Specifically, the side frame 30L is configured to include a pair of front and rear vertical pillar portions 31F, 31R extending in the vertical direction, a lower frame portion 32 extending in the front-rear direction and connecting the lower ends of the pair of vertical pillar portions 31F and 31R, an upper frame portion 33 extending in the front-rear direction and connecting the upper ends of the pair of vertical pillar portions 31F and 31R, and a cover portion 34 constituting the central portion of the side frame 30L.

The vertical pillar portions 31F and 31R, the lower frame portion 32, and the upper frame portion 33 are formed in a roughly U-shape open to the inside in the left-right direction of the skeleton frame 20 (the right side and the center side in the width direction of the skeleton frame 20) in a cross-sectional view seen from the respective longitudinal directions. Further, the left side surfaces of the vertical pillar portions 31F and 31R, the lower frame portion 32, and the upper frame portion 33 (that is, the surfaces constituting the outer peripheral surface of the skeleton frame 20) are arranged flush with each other.

The pair of front and rear vertical pillar portions 31F and 31R extend in the vertical direction as described above to form the front end portion and the rear end portion of the side frame 30L. The rear wall of the vertical pillar portion 31R on the rear side is configured as a panel fixing piece 31A as a "fixing piece" for fixing the back panel 50 described later, and the tip end side portion (right end side portion) of the panel fixing piece 31A projects to the right side of the front wall of the vertical pillar portion 31R. A pair of upper and lower fixing holes 31B (cf. FIG. 6B) are formed through the panel fixing piece 31A. Further, an upper connecting recess 31C (cf. FIG. 7A) is formed at the upper ends of the vertical pillar portions 31F and 31R. The upper connecting recess 31C is formed in a roughly bottomed rectangular cylinder that is open upward. Further, an engagement hole 31D is formed through the right wall of the upper connecting recess 31C.

The lower frame portion 32 extends in the front-rear direction, is arranged below the vertical pillar portions 31F and 31R, and is connected to the lower end portions of the vertical pillar portions 31F and 31R. Further, the lower frame portion 32 projects to the right side of the pair of vertical pillar portions 31F and 31R. Specifically, the right end portion of the lower frame portion 32 extends to the right end portion of the panel fixing piece 31A. As a result, the side frame 30L is formed into a roughly L-shape when viewed from the front side. It is configured that the portion of the lower frame portion 32 that protrudes more than the pair of vertical pillar portions 31F and 31R is configured as the support portion 32A, and the support portion 32A receives the left end portion of the bottom wall 62A of the case 60, which will be described later, from below. The panel fixing piece 31A described above extends downward and is connected to the rear end portion of the lower wall of the lower frame portion 32.

A hollow portion 32B opened to the right side is formed in the middle portion in the longitudinal direction of the lower wall of the lower frame portion 32, and a portion of the lower wall of the lower frame portion 32 excluding the front end portion and the rear end portion is hollowed to the left side. Further, a third panel mounting portion 37, which will be described later, is formed at the rear end portion of the upper wall of the lower frame portion 32.

At the front end and the rear end of the lower frame portion 32, lower connecting cylinder portions 32C as a pair of front and rear "lower connecting portions" corresponding to the above-mentioned upper connecting recesses 31C are formed. The lower connecting cylinder portion 32C is formed in a roughly rectangular tubular shape with the vertical direction as the axial direction, and protrudes downward from the left end portion of the lower frame portion 32. In the skeleton frame 20 arranged at the bottom tier, the lower connecting cylinder portion 32C is configured as a leg portion of the storage case 10. Further, on the right wall of the lower connecting cylinder portion 32C, an engagement hook 32D protruding to the right side is formed at a position corresponding to the engagement hole 31D of the upper connecting recess 31C.

In the skeleton frames 20 stacked vertically, the lower connecting cylinder portion 32C of the upper side side frame 30L is fitted into the upper connecting recess 31C of the lower side side frame 30L so that the skeleton frames 20 are connected to each other. In the connected state of the skeleton frames 20, the engagement hook 32D of the upper side side frame 30L is inserted into the engagement hole 31D of the upper connecting recess 31C of the lower side side frame 30L so that the engagement hook 32D and the engagement hole 31D engage with each other.

A pipe mounting portion 32E as a "mounting portion" for mounting the connecting pipe 40, which will be described later, is formed at the front end portion of the lower frame portion 32. The pipe mounting portion 32E is formed in a rectangular tubular shape open to the right side (inside in the left-right direction of the skeleton frame 20), and the front surface of the pipe mounting portion 32E is arranged flush with the front surface of the vertical pillar portion 31F on the front side. An engagement hole 32F is formed through the front wall of the pipe mounting portion 32E.

On the lower wall of the lower frame portion 32, a pair of front and rear lower connecting recesses 32G are formed on the inner side in the front-rear direction with respect to the lower connecting cylinder portion 32C. The lower connecting recess 32G is formed in a roughly bottomed rectangular cylinder that is open downward, and protrudes upward from the lower wall of the lower frame portion 32. Further, an engagement hole 32H is formed through the right wall of the lower connecting recess 32G at a roughly central portion.

The lower frame portion 32 is formed with a first sub-mounting portion 32J at a position adjacent to the rear side of the pipe mounting portion 32E, and the first sub-mounting portion 32J is formed in a rectangular tubular shape open to the right. Further, a second sub-mounting portion 32K is formed at the rear end portion of the lower frame portion 32, and the second sub-mounting portion 32K is formed in a roughly rectangular cylinder shape open to the right side, and a part of the outer peripheral portion of the second sub-mounting portion 32K is open.

The upper frame portion 33 extends in the front-rear direction as described above, and is arranged between the upper end portions of the pair of front-rear vertical pillar portions 31F and 31R. Both ends of the upper frame portion 33 in the longitudinal direction are connected to the upper end portions of the pair of front and rear vertical pillar portions 31F and 31R. On the upper wall of the upper frame portion 33, an upper connecting cylinder portion 33A as a pair of front and rear "upper connecting portions" is formed inside in the front-rear direction with respect to the upper connecting recess 31C (more specifically, the position corresponding to the lower connecting recess 32G). In other words, the upper connecting cylinder portion 33A is arranged inside in the front-rear direction of the two lower connecting cylinder portions 32C in the side frame 30L in a plan view. The upper connecting cylinder portion 33A is formed in a roughly rectangular tubular shape with the vertical direction as the axial direction, and protrudes upward from the upper frame portion 33. Further, an engagement hook 33B protruding to the right side is formed on the right wall of the upper connecting cylinder portion 33A.

In the connected state of the skeleton frames 20, the upper connecting cylinder portion 33A of the lower side side frame 30L is fitted into the lower connecting recess 32G of the upper side side frame 30L. In this state, the engagement hook 33B of the lower side side frame 30L is inserted into the engagement hole 32H of the upper side side frame 30L, and the engagement hook 33B and the engagement hole 32H are engaged with each other.

It is preferable that the protruding length of the lower connecting cylinder portion 32C protruding downward from the lower frame portion 32 is longer than the protruding length of the upper connecting cylinder portion 33A protruding upward from the upper frame portion 33. As a result, the stability when the skeleton frames 20 are stacked in the vertical direction can be improved, and the thickness of the top plate 70, which will be described later, can be optimized.

Further, at the rear end of the side frame 30L, a first panel mounting portion 35, a second panel mounting portion 36, third panel mounting portion 37, and forth panel mounting portion 38 are formed as "panel mounting portions" for mounting the back panel 50 described later.

The first panel mounting portion 35 is formed in a roughly U-shaped plate shape that is open to the rear side when viewed from the right side, and is projected from the upper end portion of the vertical pillar portion 31R on the rear side to the right side, and connected to the panel fixing piece 31A. At the connection portion of the first panel mounting portion 35 with the panel fixing piece 31A, a first slit 35A as a pair of upper and lower "slits" opened to the right side is formed.

The second panel mounting portion 36 is formed in a roughly T-shaped plate shape rotated approximately 90 degrees to the rear side when viewed from the right side, and is projected to the right side from the vertical intermediate portion of the vertical pillar portion 31R on the rear side, and connected to the panel fixing piece 31A. A second slit 36A as a "slit" opened to the right side is formed at the connection portion of the second panel mounting portion 36 with the panel fixing piece 31A.

The third panel mounting portion 37 is formed at the rear end portion of the upper wall of the lower frame portion 32 described above. The third panel mounting portion 37 is bent upward and rearward in a roughly crank shape when viewed from the right side, and is connected to the panel fixing piece 31A. A third slit 37A as a "slit" opened to the right side is formed at the connection portion of the third panel mounting portion 37 with the panel fixing piece 31A.

The fourth panel mounting portion 38 is formed in a roughly F-shaped plate shape when viewed from the right side, and is projected from the rear end portion of the left side wall of the lower frame portion 32 to the right side, and connected to the lower wall of the panel fixing piece 31A and the lower frame portion 32. A fourth slit 38A as a pair of upper and lower "slits" opened to the right side is formed at the connection portion of the fourth panel mounting portion 38 with the panel fixing piece 31A.

The upper side fixing hole 31B in the panel fixing piece 31A described above is arranged between the upper and lower pair of first slits 35A of the first panel mounting portion 35. Further, the lower side fixing hole 31B is arranged between the third slit 37A and the fourth slit 38A. Further, a stopper piece 39 is formed at the upper end of the panel fixing piece 31A. The stopper piece 39 is arranged with the vertical direction as the plate thickness direction, extends forward from the panel fixing piece 31A, and is connected to the upper connecting cylinder portion 33A on the rear side.

The cover portion 34 is formed in a roughly rectangular plate shape with the left-right direction as the plate thickness direction, and the outer peripheral portion of the cover portion 34 is connected to the pair of vertical pillar portions 31F and 31R, the lower frame portion 32, and the upper frame portion 33. Further, the left side surface of the cover portion 34 is arranged at a position slightly lower to the right side than the left side surface of the vertical pillar portions 31F and 31R, the lower frame portion 32, and the upper frame portion 33.

<Connecting Pipe 40>

As shown in FIGS. 2 to 4, and 8, the connecting pipe 40 is formed in the shape of a roughly long rod extending in the left-right direction as a whole. The connecting pipe 40 includes a pipe body 42 as a "pipe" extending in the left-right direction, and a pair of left and right caps 44L and 44R fixed to both ends in the longitudinal direction of the pipe body 42.

The pipe body 42 is made of a metal pipe material and is formed in a roughly cylindrical shape with the left-right direction as the axial direction.

The pair of left and right caps 44L and 44R are made of a resin material. The pair of caps 44L and 44R are configured symmetrically with respect to the central portion in the longitudinal direction of the connecting pipe 40. Therefore, the cap 44L will be described below, and the description of the cap 44R will be omitted as appropriate. The cap 44L is formed in a roughly bottomed rectangular cylinder that is open to the right side. Four fitting ribs 45 (cf. FIG. 8B) are formed on the inner peripheral surface of the cap 44L. The fitting rib 45 extends from the corners of the four corners of the cap 44L toward the center of the cap 44L. Then, the left end portion of the pipe body 42 is fitted into the cap 44L and is in contact with the tip portions of the four fitting ribs 45. Further, the cap 44L is fixed to the pipe body 42 by caulking.

An engagement hook portion 46 is formed on the front surface of the cap 44L, and the engagement hook portion 46 projects forward from the cap 44L. Then, the cap 44L (44R) is fitted into the pipe mounting portion 32E of the side frame 30L (30R), and the connecting pipe 40 is mounted on the side frames 30L and 30R. As a result, the connecting pipe 40 is bridged over the front ends of the side frames 30L and 30R, and the front ends of the side frames 30L and 30R are connected by the connecting pipe 40. Further, in the connected state of the connecting pipe 40 to the side frames 30L and 30R, the engagement hook portion 46 of the caps 44L and 44R is inserted into the engagement hole 32F of the side frames 30L and 30R so that the engagement hook portion 46 and the engagement hole 32F engage with each other.

Then, by making the connecting pipe 40 have the above configuration, the caps 44L and 44R absorb the tolerance of the outer diameter of the pipe body 42, and the outer peripheral portion of the caps 44L and 44R is brought into contact with the inner peripheral surface of the pipe mounting portion 32E of the side frame 30L (30R), and the caps 44L and 44R can be fixed to the side frames 30L and 30R. As a result, it is possible to stabilize the connecting pipe 40 bridging the side frames 30L and 30R.

Further, it is preferable that the length of the caps 44L and 44R in the axial direction (left-right direction) is shorter than the depth of the pipe mounting portion 32E. As a result, the entire caps 44L and 44R are fitted into the pipe mounting portion 32E, and the connecting pipe 40 can be stably fixed to the side frames 30L and 30R.

<Back Panel 50>

As shown in FIGS. 2 to 4, the back panel 50 is made of synthetic wood and is formed in a roughly rectangular plate shape with the front-rear direction as the plate thickness direction. The plate thickness of the back panel 50 is set to be thicker than the plate thickness of the side frames 30L and 30R (in this embodiment, the plate thickness of the back panel 50 is set to 3 mm). The material of the back panel 50 is not particularly limited, and any material which is light-weight and has a thin thickness, including a resin material, may be used. Notches 51 that are open to the upper side and to the outside in the left-right direction are formed at the two corners on the upper side of the back panel 50. Further, a pair of upper and lower fixing holes 52 are formed through the back panel 50 at both ends in the left-right direction at positions corresponding to the fixing holes 31B of the side frames 30L and 30R.

Both ends of the back panel 50 in the left-right direction are arranged adjacent to the front side of the panel fixing pieces 31A of the side frames 30L and 30R, and the back panel 50 is fixed to the panel fixing piece 31A by a fastening member such as a grommet G. Specifically, both ends of the back panel 50 in the left-right direction are inserted into the first slit 35A, the second slit 36A, the third slit 37A, and the fourth slit 38A of the side frames 30L and 30R. The grommet G is inserted from the rear side into the fixing holes 31B of the side frames 30L and 30R and the fixing holes 52 of the back panel 50, and the back panel 50 is fixed to the side frames 30L and 30R. In the fixed state of the back panel 50 to the side frames 30L and 30R, the notch 51 of the back panel 50 is arranged adjacent to the lower side of the stopper piece 39 of the side frames 30L and 30R, and the lower corner portion of the back panel 50 is arranged adjacent to the upper side of the lower wall in the lower frame portion 32 of the side frames 30L and 30R. As a result, the rear ends of the side frames 30L and 30R are connected by the back panel 50.

(Case 60)

As shown in FIGS. 3 and 4, the case 60 is formed as a roughly rectangular parallelepiped box shape that is open upward as a whole, and is arranged in the case accommodating portion 22 of the skeleton frame 20 so as to be slidable in the front-rear direction. That is, the case 60 is configured to be able to be pulled out from the case accommodating portion 22. The case 60 includes a case body 62 and a front panel 64.

The case body 62 is formed in a roughly rectangular parallelepiped box shape that is open upward. Specifically, the case body 62 includes an roughly rectangular plate-shaped bottom wall 62A with the vertical direction as the plate thickness direction and the left and right direction as the longitudinal direction, a side wall 62B extending upward from both ends in the left-right direction of the bottom wall 62A, a rear wall 62C extending upward from the rear end portion of the bottom wall 62A, and a front wall 62D extending upward from the front end portion of bottom wall 62A. The inside of the case body 62 is configured as a storage portion 62E for storing stored items. In the state where the case 60 is housed in the case accommodating portion 22, both left and right ends of the bottom wall 62A of the case body 62 are placed on the upper side of the support portion 32A of the side frames 30L and 30R and supported by the support portion 32A.

The side wall 62B is inclined outward in the left-right direction toward the upper side, the rear wall 62C is inclined toward the rear side toward the upper side, and the front wall 62D is inclined toward the front side toward the upper side. As a result, in the disassembled state of the storage case 10, the case body 62 is configured to be capable of nesting by stacking the case main bodies 62 on top of each other (cf. FIGS. 12, 14, and 16).

A flange portion 62F is formed at the upper end portion of the case body 62 except for the front wall 62D. The flange portion 62F extends horizontally from the upper end portion of the case body 62 to the outside of the case body 62 (the side opposite to the storage portion 62E), and the tip end portion of the flange portion 62F is bent downward. Further, nesting ribs 62G are formed at the front end portion and the rear end portion of the upper end portion of the side wall 62B. The nesting rib 62G extends downward from the flange portion 62F with the front-rear direction as the plate thickness direction. In the nesting state of the case body 62, the lower end portion of the nesting rib 62G of the upper side case body 62 is placed on the upper surface of the flange portion 62F of the lower side case body 62. As a result, in the nesting state of the case body 62, the bottom walls 62A of the upper and lower case bodies 62 are arranged apart from each other in the vertical direction (cf. FIGS. 12, 14, and 16).

A mounting piece 62H projecting downward is formed at the front end portion of the bottom wall 62A, and the mounting piece 62H extends in the left-right direction with the front-rear direction as the plate thickness direction. Further, a plurality (7 locations in this embodiment) of guide ribs 62J are formed on the lower surface of the bottom wall 62A, and the guide ribs 62J extend rearward from the mounting piece 62H and extend to the rear end portion of the bottom wall 62A. The guide ribs 62J are arranged at predetermined intervals in the left-right direction. A downwardly overhanging portion 62J1 is formed at the front end portion of the guide rib 62J, and the overhanging portion 62J1 is formed in a roughly triangular shape in a side view. When the case 60 is housed in the case accommodating portion 22 of the skeleton frame 20, the inclined portion of the overhanging portion 62J1 abuts on the pipe body 42 of the connecting pipe 40, and the movement of the case 60 to the rear side is restricted. Further, in this state, the guide ribs 62J are arranged between the lower frame portions 32 of the pair of side frames 30L and 30R.

Figure 10:
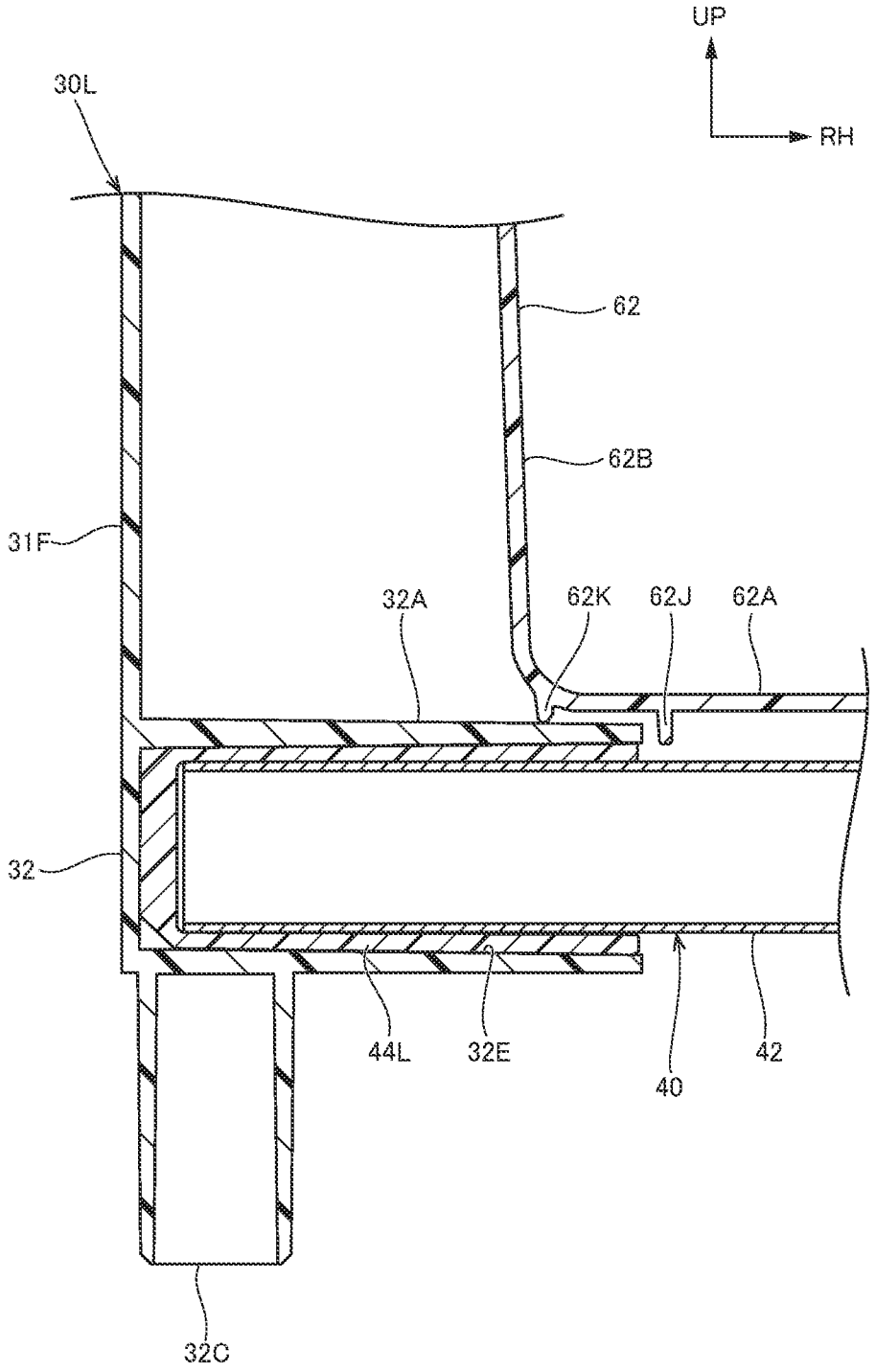
FIG. 10 is a cross-sectional view seen from the front side showing a lower left corner portion of the case in a state where the case shown in FIG. 1 is housed in the case accommodating portion of the skeleton frame.

As shown in FIG. 10, the two guide ribs 62J provided on both sides of the case body 62 in the left-right direction (width direction) in the guide ribs 62J are arranged close to the inside of the case body 62 in the width direction with respect to the right end (left end) of the lower frame portion 32 of the side frame 30L (30R). Specifically, a slight gap (1 mm to 1.5 mm in the present embodiment) is formed between the guide rib 62J and the right end (left end) of the lower frame portion 32 in the left-right direction. As a result, the guide rib 62J comes into contact with the lower frame portion 32, so that the displacement of the case body 62 in the left-right direction is limited. That is, the guide rib 62J is guided by the lower frame portion 32 when the case body 62 moves in the front-rear direction.

A pair of left and right sliding ribs 62K are formed on the lower surface of the bottom wall 62A at both ends in the left-right direction (more specifically, the left and right corners), and the sliding rib 62K extends rearward from the mounting piece 62H and extends to the rear end portion of the bottom wall 62A. The lower end of the sliding rib 62K is arranged above the lower end of the guide rib 62J and is in contact with (mounted on) the upper surface of the lower frame portion 32 (support portion 32A) in the side frame 30L (30R). As a result, when the case body 62 is moved back and forth, the lower end of the sliding rib 62K slides on the upper surface of the lower frame portion 32 (support portion 32A) while the guide rib 62J is guided by the lower frame portion 32. Therefore, when the case body 62 is moved back and forth, the case body 62 is prevented from rattling or wobbling, and the case body 62 can be moved smoothly. A predetermined gap is formed in the vertical direction between the guide rib 62J and the connecting pipe 40, and when the case body 62 is moved back and forth, the guide rib 62J is configured to move the upper side of the connecting pipe 40.

As shown in FIGS. 3 and 4, the front panel 64 is formed in the shape of a rectangular box having a relatively shallow bottom that is open to the rear side. The outer peripheral portion of the front panel 64 is extrapolated to the front wall 62D of the case body 62 and the mounting piece 62H, and the front panel 64 is assembled to the case body 62. The front panel 64 is curved in an arc shape that is convex toward the front side when viewed from above. Further, a recessed portion 64A opened downward is formed at the lower end of the front panel 64. Further, an inclined portion 64B is formed at the upper end portion of the front panel 64, and the inclined portion 64B is inclined to the rear side toward the upper side. As a result, in the storage case 10, a space is formed between the recessed portion 64A of the upper side case 60 and the inclined portion 64B on the lower side, and by inserting the user's hand into the space, the user can grasp the recessed portion 64A and pull out the case 60.

(Top Plate 70)

Figure 9:
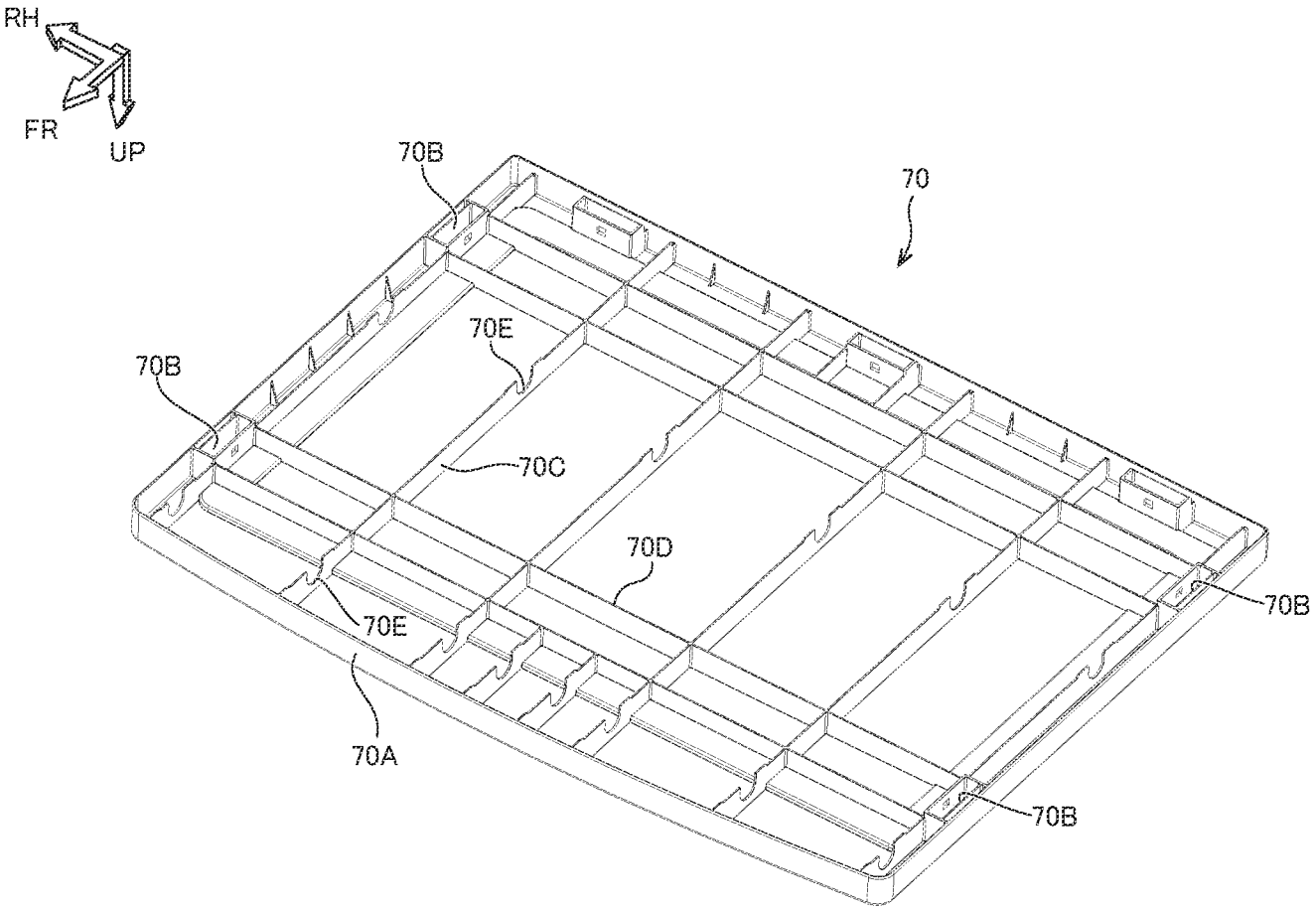
FIG. 9 is a perspective view of the top plate shown in FIG. 4 from the lower side.

As shown in FIGS. 3, 4, and 9, the top plate 70 is formed in a roughly rectangular plate shape with the vertical direction as the plate thickness direction and the left and right direction as the longitudinal direction. Further, an outer peripheral wall 70A bent downward is formed on the outer peripheral edge portion of the top plate 70, and the outer peripheral wall 70A is formed over the entire circumference in the circumferential direction of the top plate 70. A pair of front and rear top plate connecting portions 70B are formed on the lower surface of the top plate 70 at both ends in the left-right direction, and the top plate connecting portions 70B are formed in a roughly rectangular tubular shape. Further, the top plate connecting portion 70B is arranged at a position corresponding to the upper connecting cylinder portion 33A of the side frames 30L and 30R. Then, the upper connecting cylinder portion 33A of the uppermost skeleton frame 20 is inserted into the top plate connecting portion 70B, and the top plate 70 is assembled to the skeleton frame 20.

Further, on the lower surface of the top plate 70, a plurality of first reinforcing ribs 70C extending in the front-rear direction and a plurality of second reinforcing ribs 70D extending in the left-right direction are formed, and the first reinforcing rib 70C and the second reinforcing rib 70D intersect with each other. The first reinforcing rib 70C is formed with a mounting recess 70E for mounting the reinforcing pipe 72 (cf. FIG. 3), and the mounting recess 70E is formed in a concave shape open downward when viewed from the left-right direction. A reinforcing pipe 72 extending in the left-right direction is attached to the mounting recess 70E, and the top plate is reinforced by the reinforcing pipe 72. In the present embodiment, the mounting recess 70E is formed in the first reinforcing rib 70C so that the two reinforcing pipes 72 can be mounted on the top plate 70. Specifically, the reinforcing pipe 72 is attached to the front end portion and the front-rear direction intermediate portion of the top plate 70.

(Effects)

Next, the operation and effect of the present embodiment will be described while explaining the packing form of the storage case 10. In the following description of the packing form of the storage case 10, the storage case 10 will be described as a packing form having four tiers, five tiers, and six tiers, respectively.

(Packing Form when the Storage Case 10 has Four Tiers)

Figure 11:
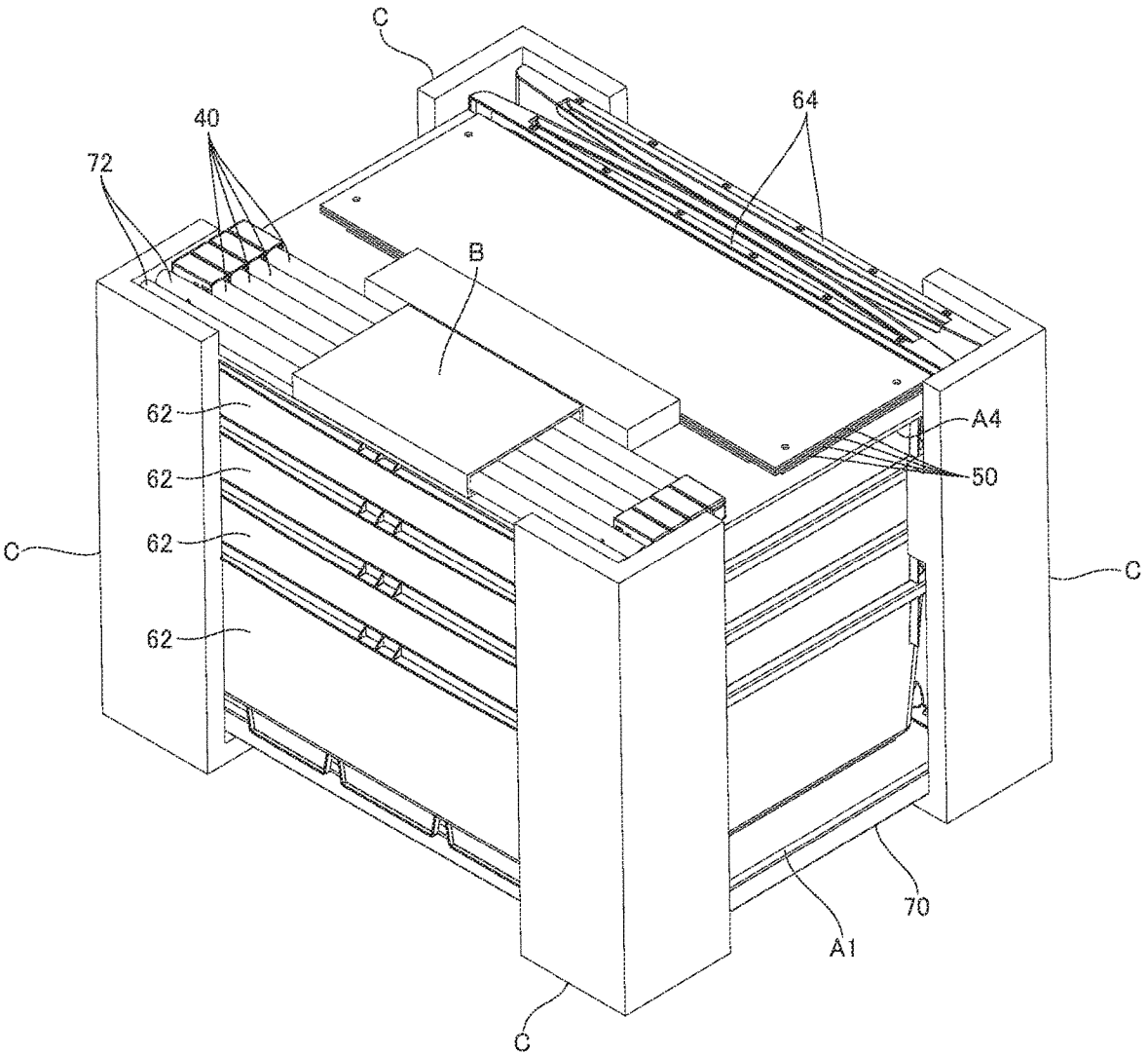
FIG. 11 is explanatory drawing for demonstrating the packing form in a four-tiered storage case.
Figure 12:
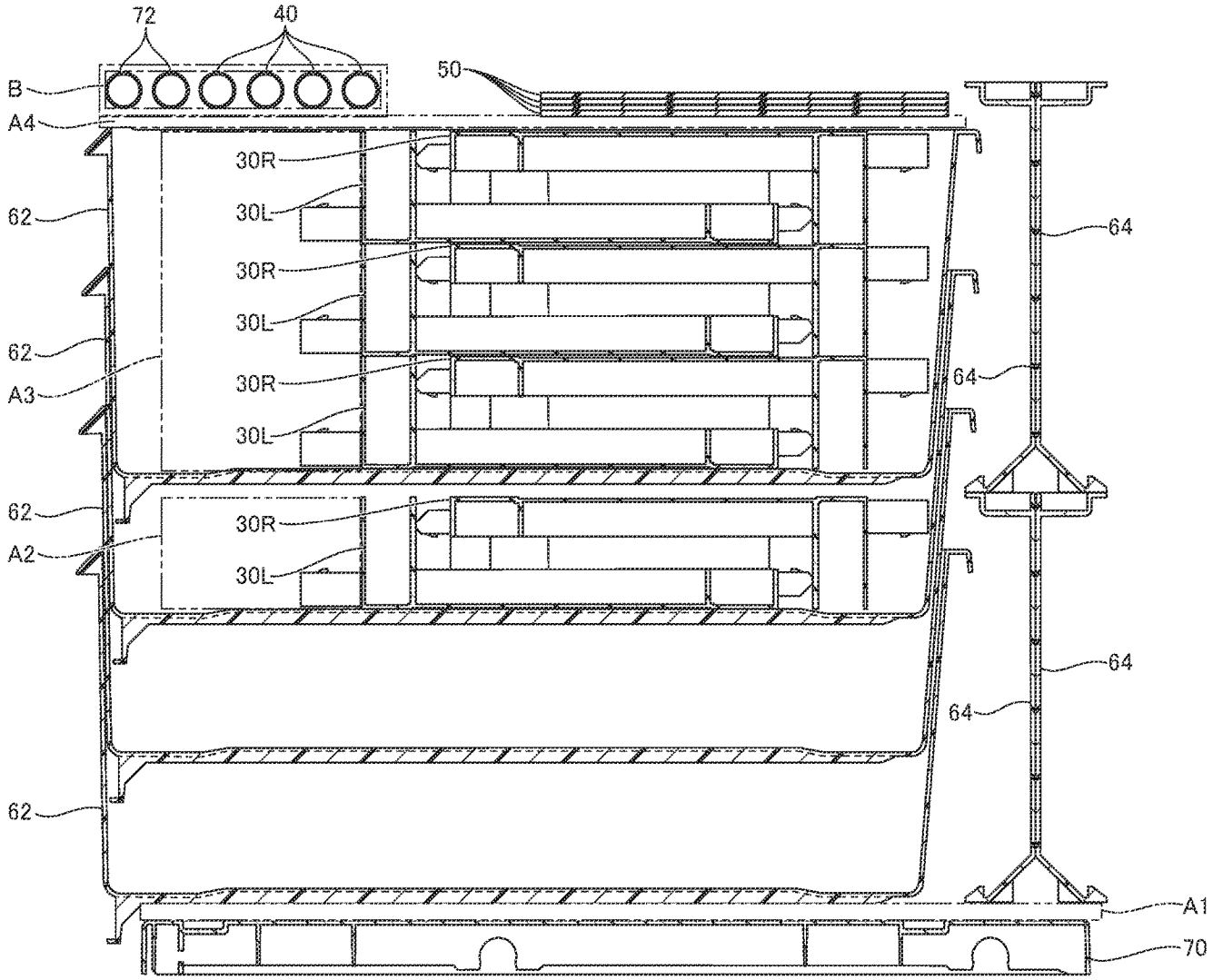
FIG. 12 is a vertical sectional view of the packing form shown in FIG. 11.

As shown in FIGS. 11 and 12, in the packing form of the four-tiered storage case 10, the rectangular plate-shaped cushioning material A1 is placed on the upper side of the top plate 70. The nested case body 62 is placed on the upper side of the cushioning material A1. The side frames 30L and 30R are housed inside the case body 62, which is the second tier from the top. Specifically, the side frame 30R is turned upside down with respect to the side frame 30L, and the side frames 30L and 30R are arranged so as to face each other. The side frames 30L and 30R in this state are housed inside the case body 62 at the second tier from the top.

Inside the uppermost case body 62, the side frames 30L and 30R arranged so as to face each other are housed in a state of being stacked in three tiers. The cushioning material A2 is housed inside the second tier case body 62, and the cushioning material A3 is housed inside the uppermost case body 62.

Next, the rectangular plate-shaped cushioning material A4 is placed on the upper side of the uppermost case body 62. Then, the two reinforcing pipes 72 and the four connecting pipes 40 are placed on the upper side of the cushioning material A4 in a state of being bundled by the binding material B. Further, four back panels 50 are placed on the upper side of the cushioning material A4 in a state of being stacked vertically.

Further, four front panels 64 are arranged on the rear side of the nested case body 62. Specifically, the two front panels 64 are placed on the upper side of the cushioning material A1, and the other two front panels 64 are placed on the upper side of the two front panels 64 placed on the cushioning material A1.

As described above, in the packing form of the four-tiered storage case 10, parts other than the top plate 70 constituting the storage case 10 are stacked on the top plate 70, and the packing form of the storage case 10 is formed into a roughly rectangular parallelepiped shape. In the packing form of the storage case 10, the four corners of the top plate 70 are supported by the four packing materials C, and the four corners of the packing form of the storage case 10 are covered with the packing material C.

(Packing Form when the Storage Case 10 has 5 Tiers)

Figure 13:
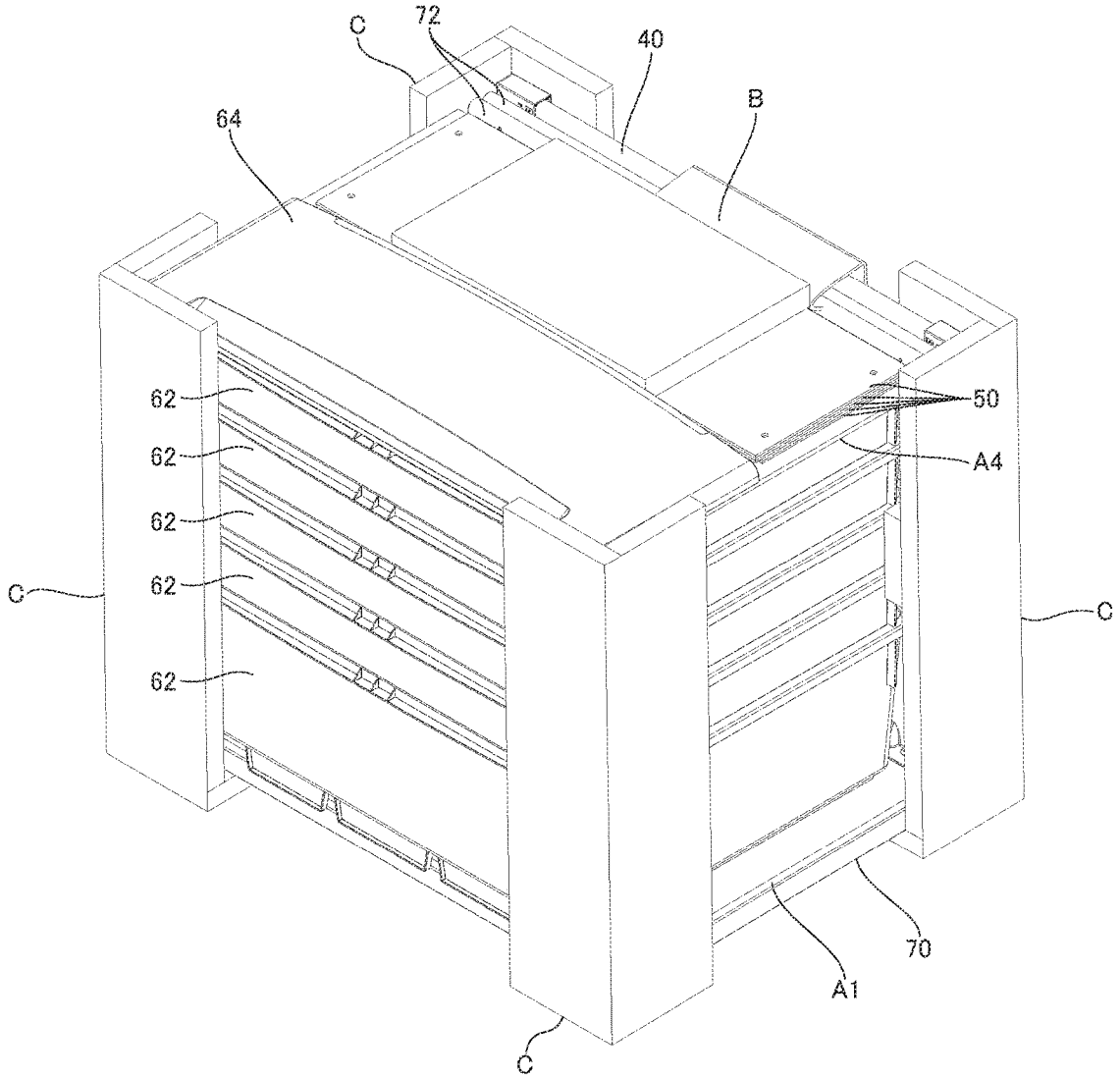
FIG. 13 is explanatory drawing for demonstrating the packing form in a five-tiered storage case.
Figure 14:
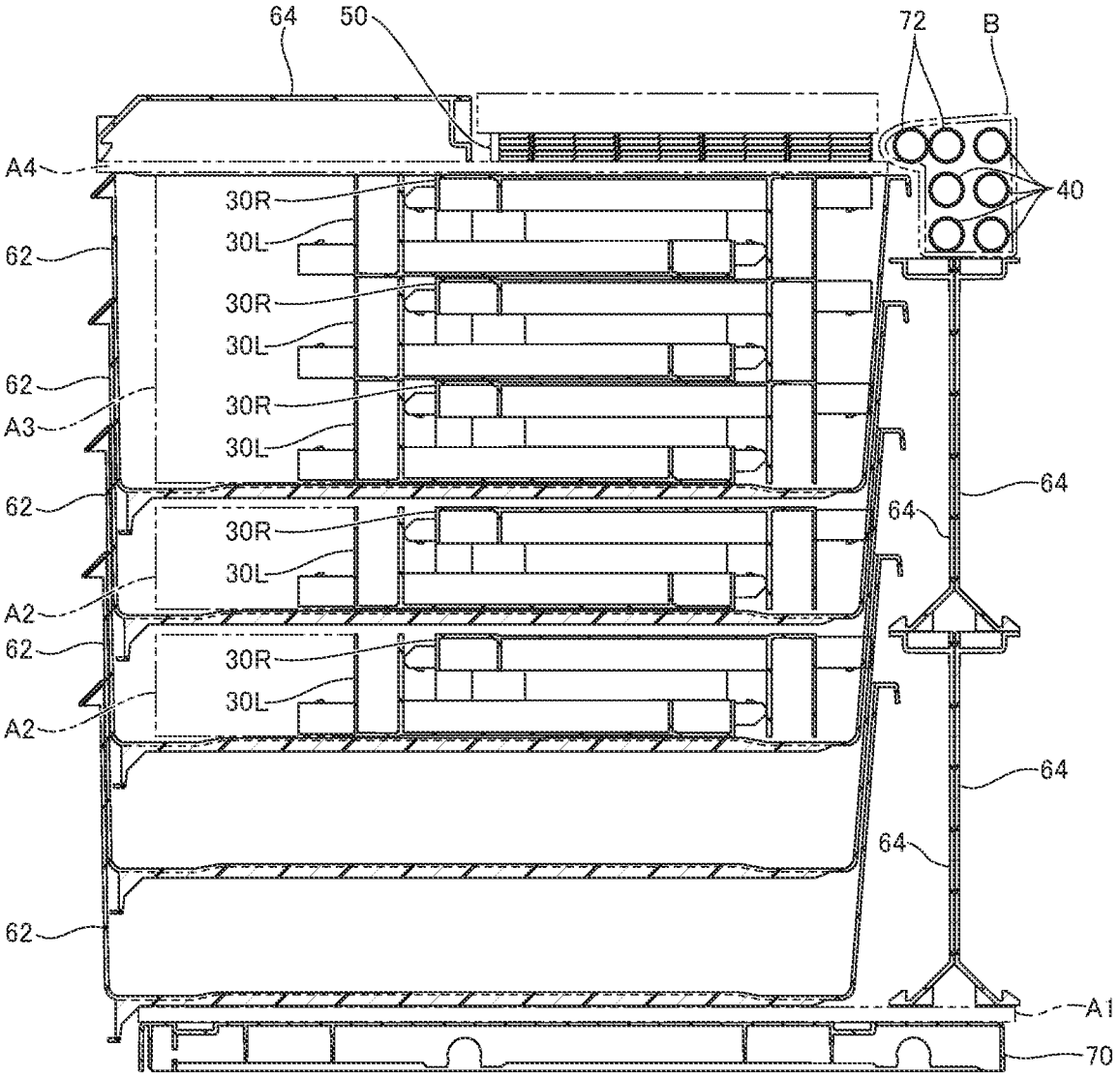
FIG. 14 is a vertical sectional view of the packing form shown in FIG. 13.

As shown in FIGS. 13 and 14, in the packing form of the five-tiered storage case 10, the rectangular plate-shaped cushioning material A1 is placed on the upper side of the top plate 70 in the same manner as described above. Then, the nested case body 62 is placed on the upper side of the cushioning material A1. Here, inside the case body 62 of the second and third tiers from the top, the side frames 30L and 30R in a state of facing each other are accommodated, and the cushioning material A2 is accommodated as well. Further, inside the uppermost case body 62, the side frames 30L and 30R arranged so as to face each other are housed in a state of being stacked in three tiers, and the cushioning material A3 is housed as well.

Next, the rectangular plate-shaped cushioning material A4 is placed on the upper side of the uppermost case body 62. Then, one front panel 64 is placed on the upper side of the cushioning material A4, and five back panels 50 are placed in a state of being stacked vertically.

Further, four front panels 64 are arranged on the rear side of the nested case body 62. Specifically, the two front panels 64 are placed on the upper side of the cushioning material A1, and the other two front panels 64 are placed on the upper side of the two front panels 64 placed on the cushioning material A1. Further, the two reinforcing pipes 72 and the five connecting pipes 40 are placed on the upper side of the front panel 64 in a state of being bundled by the binding material B.

As described above, in the packing form of the five-tiered storage case 10, the same as in the case of the four-tiered storage case 10, parts other than the top plate 70 constituting the storage case 10 are stacked on the top plate 70, and the packing form of the storage case is formed into a roughly rectangular parallelepiped shape. Further, in the packing form of the storage case 10, the four corners of the top plate 70 are supported by the four packing materials C, and the four corners of the packing form of the storage case 10 are covered by the packing material C as well.

(Packing Form when the Storage Case 10 has 6 Tiers)

Figure 15:
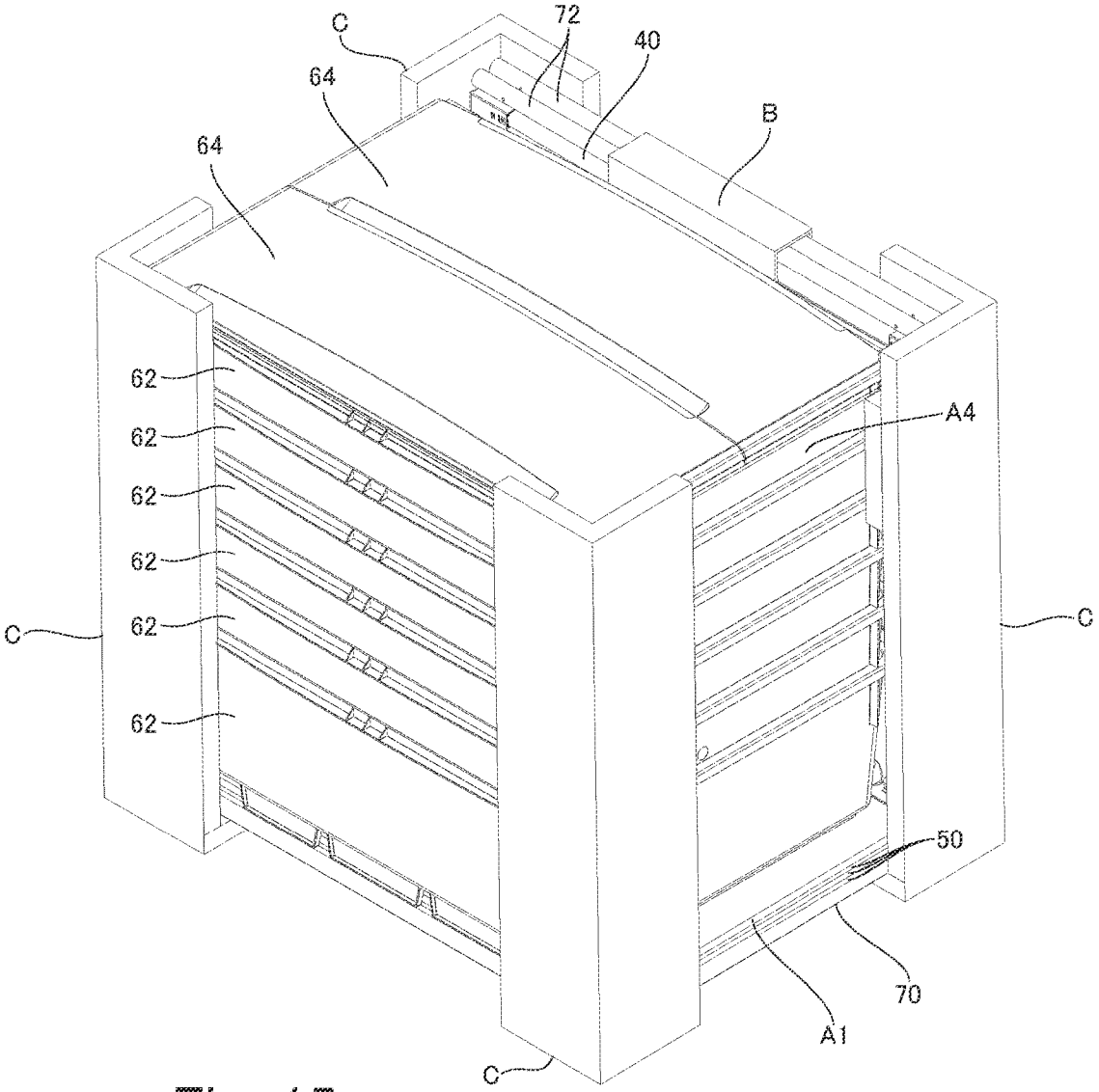
FIG. 15 is explanatory drawing for demonstrating the packing form in a six-tiered storage case.
Figure 16:
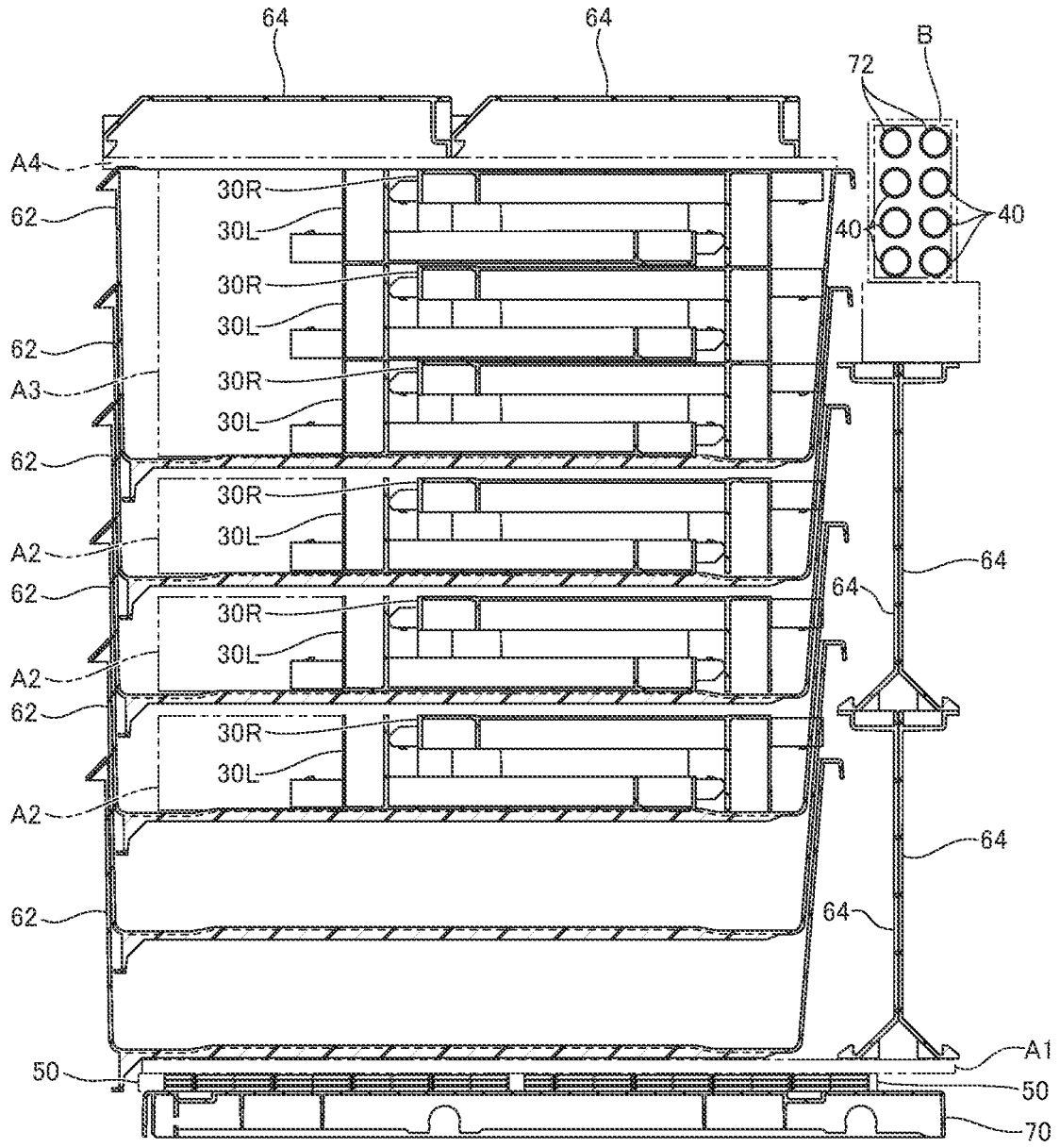
FIG. 16 is a vertical sectional view of the packing form shown in FIG. 15.

As shown in FIGS. 15 and 16, in the packing form of the six-tiered storage case 10, six back panels 50 are placed on the upper side of the top plate 70 in a state in which every three sheets are stacked one above the other. Further, a rectangular plate-shaped cushioning material A1 is placed on the upper side of the back panel 50. Then, the nested case body 62 is placed on the upper side of the cushioning material A1. Here, inside the case body 62 in the second to fourth tiers from the top, the side frames 30L and 30R in a state of facing each other are accommodated, and the cushioning material A2 is accommodated as well. Further, inside the uppermost case body 62, the side frames 30L and 30R arranged so as to face each other are housed in a state of being stacked in three tiers, and the cushioning material A3 is accommodated as well.

Next, the rectangular plate-shaped cushioning material A4 is placed on the upper side of the uppermost case body 62. Then, the two front panels 64 are placed side by side front to back on the upper side of the cushioning material A4.

Further, four front panels 64 are arranged on the rear side of the nested case body 62. Specifically, the two front panels 64 are placed on the upper side of the cushioning material A1, and the other two front panels 64 are placed on the upper side of the two front panels 64 placed on the cushioning material A1. Further, the two reinforcing pipes 72 and the six connecting pipes 40 are placed on the upper side of the front panel 64 in a state of being bundled by the binding material B.

As described above, even in the packing form of the six-tiered storage case 10, the same as in the case of the four-tiered and five-tiered storage case 10, parts other than the top plate 70 constituting the storage case 10 are stacked on the top plate 70, and the packing form of the storage case 10 is formed into a roughly rectangular parallelepiped shape. Further, in the packing form of the storage case 10, the four corners of the top plate 70 are supported by the four packing materials C, and the four corners of the packing form of the storage case 10 are covered with the packing material C.

Here, the skeleton frame 20 of the storage case 10 includes a pair of left and right side frames 30L and 30R, a connecting pipe 40 connecting the front end portions of the side frames 30L and 30R, and a back panel 50 connecting the rear end portions of the side frames 30L and 30R. Further, the side frames 30L and 30R are configured to include a pair of front and rear vertical pillar portions 31F and 31R and a lower frame portion 32 connecting the lower end portions of the pair of vertical pillar portions 31F and 31R. Then, the support portion 32A of the lower frame portion 32 protrudes inward in the left-right direction (center side in the width direction) of the storage case 10 than the pair of vertical pillar portions 31F and 31R, and both ends of the bottom wall 62A of the case 60 in the left-right direction are supported by the support portion 32A.

Therefore, in the skeleton frame 20, the bottom wall 62A of the case 60 can be supported by the support portions 32A of the side frames 30L and 30R without providing a bottom plate that supports the entire bottom wall 62A of the case 60. As a result, the skeleton frame 20 can have a structure that does not include a bottom plate that supports the entire bottom wall 62A of the case 60 from below. As a result, when the storage case 10 is disassembled, it is not necessary to vertically stack the bottom plates that receive the entire bottom wall 62A of the case 60 from the lower side, so that the space of the packing form in the storage case 10 can be saved. That is, when the skeleton frame 20 is configured to include a bottom plate that supports the entire bottom wall 62A of the case 60 from below, a packing space for stacking the top plates vertically is required, but in the storage case 10 of the present embodiment, it is possible to eliminate the need for a packing space for stacking top plates vertically.

Moreover, the connecting pipe 40 is formed in a roughly long rod shape extending in the left-right direction. Therefore, as described above, the packing space in the storage case 10 can be significantly reduced as compared with the case where the skeleton frame 20 is provided with a bottom plate that supports the entire bottom wall 62A of the case 60. As described above, according to the storage case 10 of the present embodiment, it is possible to save space in the packing form.

The lower frame portion 32 of the side frames 30L and 30R is formed with a concave pipe mounting portion 32E that is open inward in the left-right direction of the skeleton frame 20. Further, the connecting pipe 40 includes a cylindrical metal pipe body 42 and resin caps 44L and 44R that cover both ends of the pipe body 42 in the longitudinal direction and are fitted into the pipe mounting portion 32E. Therefore, it is possible to secure the rigidity of the entire storage case 10 while ensuring the mechanical strength of the connecting pipe 40.

The side frames 30L and 30R are formed with first to fourth panel mounting portions 35, 36, 37, 38. The first to fourth slits 35A, 36A, 37A, 38A opened inward in the left-right direction are formed at the connection portion of the first to fourth panel mounting portions 35, 36, 37, 38 with the panel fixing piece 31A. The back panel 50 is inserted into the first to fourth slits 35A, 36A, 37A, 38A and fixed to the panel fixing piece 31A by the grommet G. As a result, the movement in the front-rear direction at both ends of the back panel 50 in the left-right direction is restricted by the first to fourth slits 35A, 36A, 37A, and 38A, so that the fixed state of the back panel 50 can be stabilized. Further, since the movement of the back panel 50 in the front-rear direction is restricted, the back panel 50 can be easily fixed to the panel fixing piece 31A by the grommet G. Thereby, the assemblability of the back panel 50 can be improved.

Further, an upper connecting recesses 31C are formed at the upper end portions of the vertical pillar portions 31F and 31R of the side frames 30L and 30R, and the lower frame portions 32 of the side frames 30L and 30R are formed with a pair of front and rear lower connecting cylinder portions 32C corresponding to the upper connecting recesses 31C. Further, the lower frame portion 32 is formed with a lower connecting recess 32G inside in the front-rear direction of the lower connecting cylinder portion 32C, and the upper frame portion 33 is formed with a pair of front and rear upper connecting cylinder portions 33A corresponding to the lower connecting recess 32G. It is configured that in the vertically stacked skeleton frames 20, the lower connecting cylinder portions 32C of the upper side side frames 30L and 30R are fitted into the upper connecting recesses 31C of the lower side side frames 30L and 30R, and the skeleton frames 20 are connected to each other. Further, the lower connecting cylinder portions 32C of the lower side side frames 30L and 30R are fitted into the lower connecting recesses 32G of the upper side side frames 30L and 30R so that the skeleton frames 20 are connected to each other. That is, the side frames 30L (side frames 30R) arranged above and below are connected at four portions. Thereby, for example, in the side frames 30L and 30R, the connected state between the side frames 30L (side frame 30R) can be better maintained as compared with the case where the lower connecting recess 32G and the upper connecting cylinder portion 33A are omitted. As a result, the rigidity of the skeleton frame 20 in a state where the skeleton frames 20 are stacked vertically can be increased.

In the storage case 10 of the present embodiment, the rear end portions of the side frames 30L and 30R are connected by the back panel 50, but the configuration for connecting the rear end portions of the side frames 30L and 30R is not limited to this. For example, although not shown, the rear end portions of the side frames 30L and 30R may be connected by a connecting pipe configured in the same manner as the connecting pipe 40 instead of the back panel 50. In this case, the cap of the connecting pipe may be fitted into the second sub-mounting portion 32K of the side frames 30L and 30R, and the connecting pipe may be mounted on the side frames 30L and 30R. Further, in this case, the cap of the connecting pipe may be appropriately changed according to the shape of the second sub-mounting portion 32K. In this case, the connecting pipe corresponds to the rear connecting member and the rod-shaped member of the present invention.

Further, in the storage case 10 of the present embodiment, the rear end portions of the side frames 30L and 30R may be connected by a connecting pipe configured in the same manner as the above-mentioned connecting pipe 40 in addition to the back panel 50. Thereby, the strength at the rear end portion of the skeleton frame 20 can be effectively increased.

Further, in the present embodiment, the back panel is fitted and fixed to the panel mounting portions (first panel mounting portion 35, second panel mounting portion 36, third panel mounting portion 37, forth panel mounting portion 38) of the side frames 30L and 30R, but the back panel 50 may be replaced with a thick back frame (thick back frame in the front-back direction of storage) similar to the side frames 30L and 30R, for example.

In this case, an upper connecting cylinder portion and an upper connecting recess similar to the upper connecting cylinders 33A and the upper connecting recesses 31C of the side frames 30L and 30R may be formed on the upper wall of the back frame, and a lower connecting cylinder portion and a lower connecting recess similar to the lower connecting cylinder portion 32C and the lower connecting recess 32G of the side frames 30L and 30R may be formed on the lower wall of the back frame. Then, in the skeleton frames 20 stacked vertically, the lower connecting cylinder portion of the upper side back frame is fitted into the upper connecting recess of the lower side back frame, and the upper connecting cylinder portion of the lower side back frame is fitted into the lower connecting recess of the upper side back frame, and the skeleton frames 20 are connected to each other.

Further, when increasing the length of the storage case 10 in the left-right direction (width direction), by applying such a back frame, for example, and by providing the connecting cylinder portion and the connecting recess provided in the back frame at three positions (both ends in the left-right direction and center part in the left-right direction) in the width direction of the back frame, it is possible to secure the strength even with a relatively large storage case 10.

Further, in the lower connecting cylinder portion and the upper connecting cylinder portion formed on the back frame, similar to the side frames 30L and 30R, it is preferable that the protruding length protruding downward from the back frame of the lower connecting cylinder portion is longer than the protruding length protruding upward from the back frame of the upper connecting cylinder portion. As a result, stability when the skeleton frames 20 are stacked in the vertical direction can be achieved, and the thickness of the top plate 70 can be optimized.

Further, in the present embodiment, the front end portions of the side frames 30L and 30R are connected by the connecting pipe 40, but the front end portions of the side frames 30L and 30R may be connected by the two connecting pipes 40. In this case, the cap 44L (44R) of the connecting pipe 40 may be fitted into the first sub mounting portion 32J of the side frame 30L (30R), and the front end portions of the side frames 30L and 30R may be connected by the two connecting pipes 40. Thereby, the rigidity of the skeleton frame 20 can be further increased.

Further, in the storage case 10 of the present embodiment, the side frames 30L and 30R are configured to include the vertical pillar portions 31F and 31R, the lower frame portion 32, the upper frame portion 33, and the cover portion 34, but in the side frames 30L and 30R, the cover portion 34 may be omitted. In this case, the side frames 30L and 30R are formed in a roughly rectangular frame shape when viewed from the left-right direction. Further, in the side frames 30L and 30R, the cover portion 34 and the upper frame portion 33 may be omitted. In this case, the side frames 30L and 30R are formed in a roughly U-shape open upward when viewed from the left-right direction.

LIST OF REFERENCE SIGNS

10 Storage case
20 Skeleton frame
22 Case accommodating portion (accommodation portion)
30L Side frame
30R Side frame
31A Panel fixing piece (fixing piece)
31C Upper connecting recess
31F Vertical pillar portion
31R Vertical pillar portion
32 Lower frame portion
32C Lower connecting cylinder portion (lower connecting portion)
32E Pipe mounting portion (mounting portion)
32G Lower connecting recess
33 Upper frame portion
33A Upper connecting cylinder (upper connecting portion)
35 First panel mounting portion (panel mounting portion)
35A First slit (slit)
36 Second panel mounting portion (panel mounting portion)
36A Second slit (slit)

37 Third panel mounting portion (panel mounting portion)
37A Third slit (slit)
38 Forth panel mounting portion (panel mounting portion)
38A Forth slit (slit)
40 Connecting pipe (front connecting member)
42 Pipe body (pipe)
44L cap
44R cap
50 Back panel (rear connecting member)
60 case
62 Case body
62J Guide rib
62K sliding rib
64 Front panel
64A recess
64B inclined portion
70 Top plate
G Grommet (fastening member)

What is claimed is:

1. A storage case comprising:
a skeleton frame that has an accommodating portion inside and can be assembled in a state where it is stacked vertically in multiple tiers;
a case that is formed in a shape of a rectangular parallelepiped box that opens upward and is housed in the accommodating portion; and
a top plate detachably assembled to the skeleton frame in an uppermost tier;
wherein the skeleton frame is configured to include:
left and right side frames, each of the left and right side frames having front and rear vertical pillar portions extending in a vertical direction and a lower frame portion that connects lower end portions of the front and rear vertical pillar portions and projects inward in a left-right direction of the skeleton frame than the front and rear vertical pillar portions to support both ends of a bottom of the case in the left-right direction, and
a rear connecting member that extends in the left-right direction and is detachably assembled to a rear end portion of each of the left and right side frames to connect the left and right side frames,
wherein the rear connecting member is configured by a rectangular plate-shaped back panel having a plate thickness direction in a front-rear direction,
each of the left and right side frames is configured to include:
a fixing piece configuring a rear surface of the respective one of the left and right side frames; and
a panel mounting portion that is arranged adjacent to a front side of the fixing piece and has a slit formed in a connection portion with the fixing piece that is open inward in the left-right direction of the skeleton frame, and
in the rear connecting member, left and right ends of the back panel are inserted into the slits of the left and right side frames, respectively, and each of the left and right ends of the back panel is fixed to the fixing piece of the respective one of the left and right side frames by a fastening member.

2. The storage case according to claim 1,
further comprising a front connecting member that is formed in a shape of a long rod extending in the left-right direction and is detachably assembled to a front end portion of the lower frame portion of each of the left and right side frames to connect the left and right side frames.

3. The storage case according to claim 1, wherein
the rear connecting member further includes a rod-shaped member extending in the left-right direction and detachably assembled to a rear end portion of the lower frame portion of each of the left and right side frames to connect the left and right side frames.

4. The storage case according to claim 1,
wherein the case is configured to include:
a case body formed in a shape of a rectangular parallelepiped box open to an upper side;
a front panel that can be detachably assembled to a front portion of the case body; and
a recess opened downward is formed at a lower end portion of the front panel, and an inclined portion is formed at an upper end portion of the front panel.

5. A storage case comprising:
a skeleton frame that has an accommodating portion inside and can be assembled in a state where it is stacked vertically in multiple tiers;
a case that is formed in a shape of a rectangular parallelepiped box that opens upward and is housed in the accommodating portion; and
a top plate detachably assembled to the skeleton frame in an uppermost tier;
wherein the skeleton frame is configured to include:
left and right side frames, each of the left and right side frames having front and rear vertical pillar portions extending in a vertical direction and a lower frame portion that connects lower end portions of the front and rear vertical pillar portions and projects inward in a left-right direction of the skeleton frame than the front and rear vertical pillar portions to support both ends of a bottom of the case in the left-right direction, and
a rear connecting member that extends in the left-right direction and is detachably assembled to a rear end portion of each of the left and right side frames to connect the left and right side frames,
wherein the rear connecting member is configured by a rectangular plate-shaped back panel having a plate thickness direction in a front-rear direction,
wherein each of the left and right side frames is configured to include:
front and rear lower connecting portions protruding downward from front and rear end portions of the lower frame portion, respectively;
front and rear upper connecting recesses formed at upper end portions of the front and rear vertical pillar portions and configured so that the front and rear lower connecting portions of another skeleton frame can be fitted;
an upper frame portion that extends in the front-rear direction and connects the upper end portions of the front and rear vertical pillar portions;
front and rear upper connecting portions formed on the upper frame portion and projecting upward from the upper frame portion; and
front and rear lower connecting recesses formed in the lower frame portion and configured so that the upper connecting portion of another skeleton frame can be fitted.

6. A storage case comprising:
a skeleton frame that has an accommodating portion inside and can be assembled in a state where it is stacked vertically in multiple tiers;

a case that is formed in a shape of a rectangular parallelepiped box that opens upward and is housed in the accommodating portion; and a top plate detachably assembled to the skeleton frame in an uppermost tier;

wherein the skeleton frame is configured to include:

left and right side frames, each of the left and right side frames having front and rear vertical pillar portions extending in a vertical direction and a lower frame portion that connects lower end portions of the front and rear vertical pillar portions and projects inward in a left-right direction of the skeleton frame than the front and rear vertical pillar portions to support both ends of a bottom of the case in the left-right direction, and a rear connecting member that extends in the left-right direction and is detachably assembled to a rear end portion of each of the left and right side frames to connect the left and right side frames, wherein the rear connecting member is configured by a rectangular plate-shaped back panel having a plate thickness direction in a front-rear direction, a guide rib and sliding rib extending in the front-rear direction are formed on a lower surface of the case, the guide rib is arranged between the left and right side frames and above a front connecting member, and abut on the lower frame portion to limit the movement of the case in the left-right direction, and the sliding rib is in contact with an upper surface of the lower frame portion.

* * * * *